US006102021A

United States Patent [19]

Sanders et al.

[11] Patent Number: 6,102,021

[45] Date of Patent: Aug. 15, 2000

[54] BASEBALL INSERTER FOR PITCHING MACHINES

[76] Inventors: Barry L. Sanders, 942 E. Mountain St., Glendale, Calif. 91207; Ross D. Beers, 2430 Los Amigos St., La Crescenta, Calif. 91214; Devinder S. Gill, 3242 Veronica Ave., West Covina, Calif. 91792; Frank E. Hill, 3068 Lori Cir., Simi Valley, Calif. 93063

[21] Appl. No.: 08/799,763

[22] Filed: Feb. 12, 1997

Related U.S. Application Data

[63] Continuation of application No. 08/278,613, Jul. 21, 1994, abandoned.

[51] Int. Cl.[7] ..... A63B 69/40

[52] U.S. Cl. ..... 124/78

[58] Field of Search ..... 124/78, 48, 51, 124/81, 50; 473/451

[56] References Cited

U.S. PATENT DOCUMENTS

| | | | |
|---|---|---|---|
| 2,716,973 | 9/1955 | Desi | 473/78 |
| 4,025,071 | 5/1977 | Hodges | 473/78 |
| 4,086,903 | 5/1978 | Scott | 473/78 |
| 4,442,832 | 4/1984 | Floyd | 473/78 |
| 4,648,596 | 3/1987 | Long | 473/48 |
| 4,723,532 | 2/1988 | Osojnak | 473/78 |

*Primary Examiner*—Theatrice Brown
*Attorney, Agent, or Firm*—Wagner Middlebrook & Kimbell

[57] ABSTRACT

A baseball pitching machine is disclosed preferably employing a counterrotating wheel type baseball launch subsystem pitching a series of baseballs and a computer controlled system for selecting the type and percentage of pitches, pitcher and batter characteristics, strike zone areas and other parameters to provide a meaningful batting training session. The pitching machine includes a ball transport subsystem including a carousel for receiving and transporting baseballs in sequence to a position adjacent the counter rotating wheels. While being transported, each baseball stops at seam orienting stations where seam rotators rotate the baseball to provide a commanded seam orientation for the particular pitch selected. The baseball is oriented by the ball orienter for insertion in the launch subsystem. A computer allows the selection by the operator of a variety of pitches, random or selected order. The computer has memory capability for storing pitches corresponding to any pitcher's typical pitch pattern and the system includes video, audio and data recording to record each batting session. An alignment system is included utilizing a laser light source. A remote control is also provided for the batter or his coach. A manual baseball inserter is disclosed for use with other pitching machines.

11 Claims, 28 Drawing Sheets

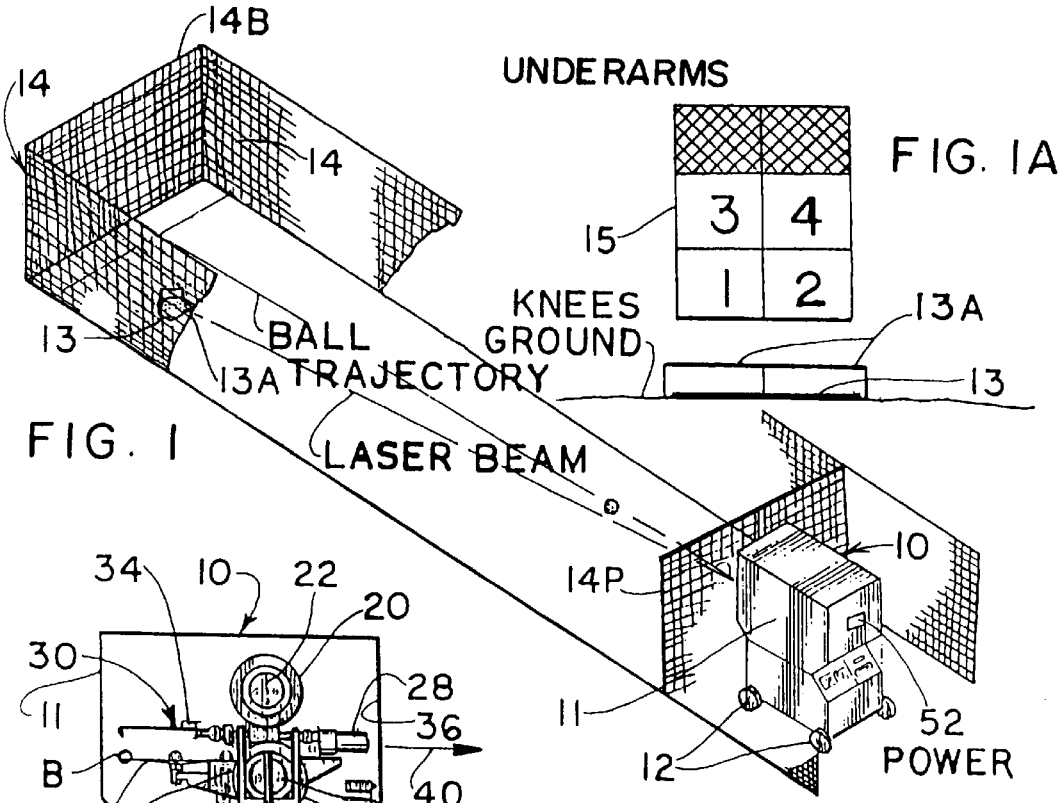
FIG. 1
FIG. 1A
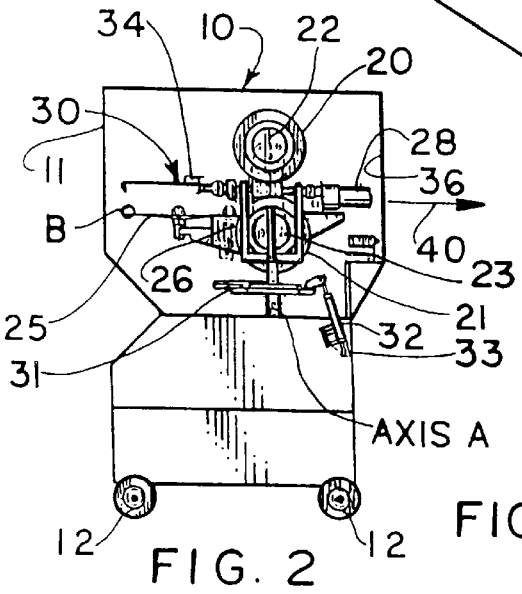
FIG. 2
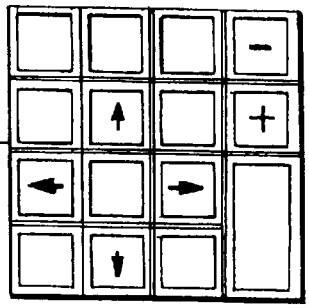
FIG. 4B
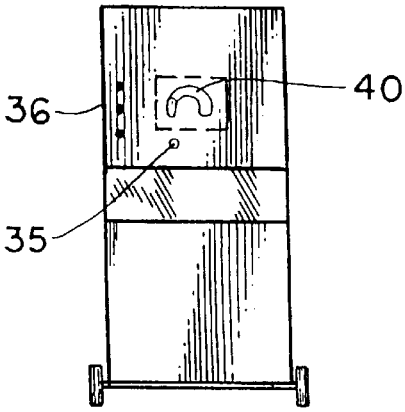
FIG. 3
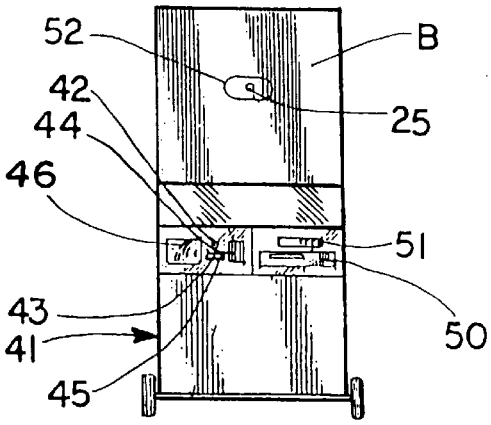
FIG. 4

FIG. 13
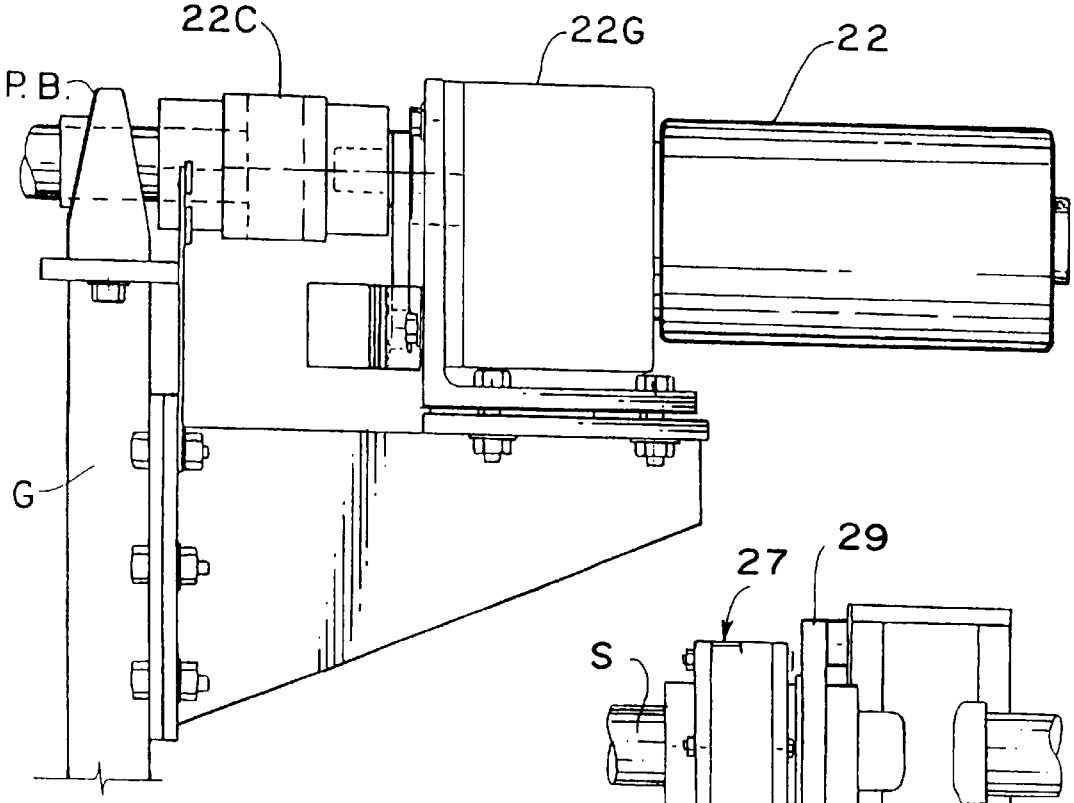
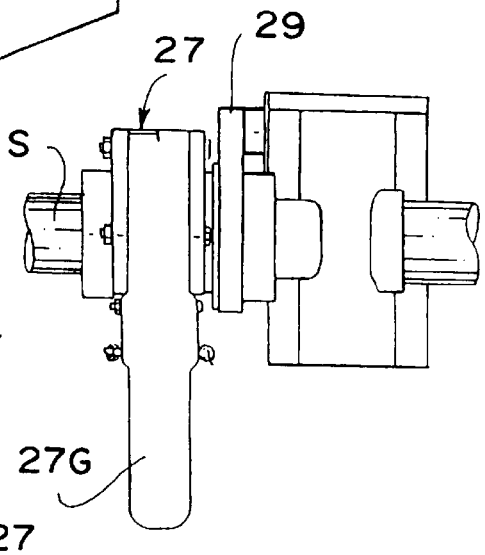
FIG. 14
FIG. 15
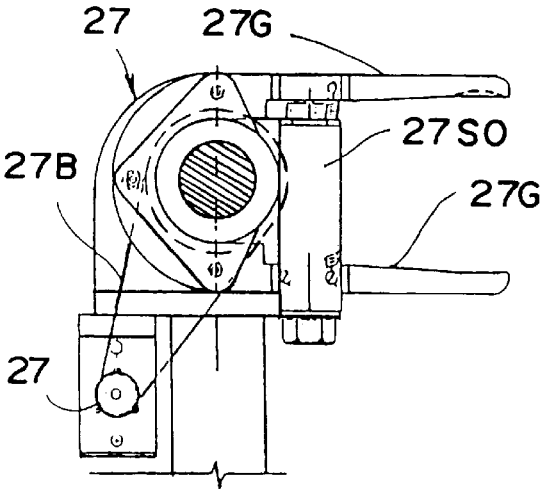
FIG. 16
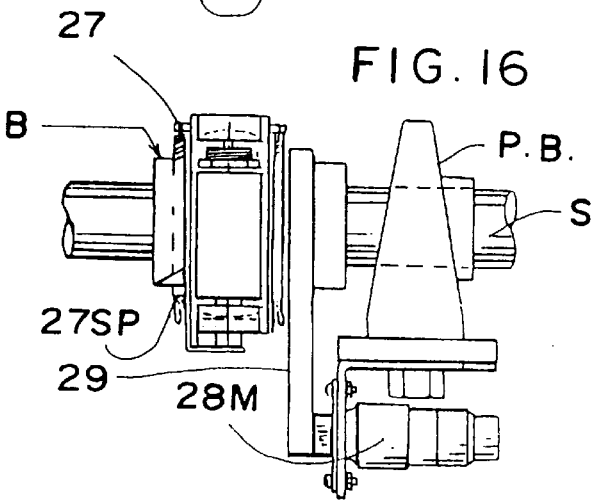

FIG. 19
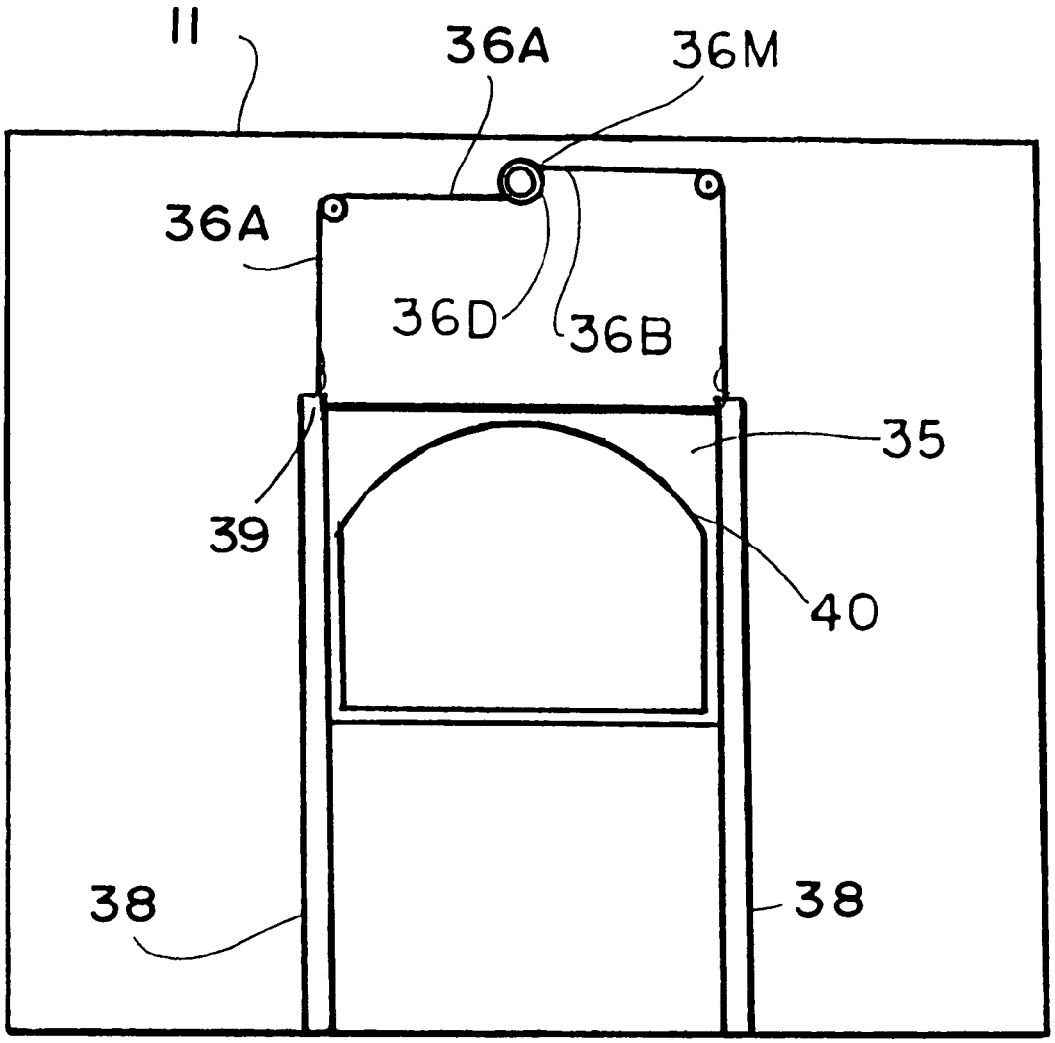
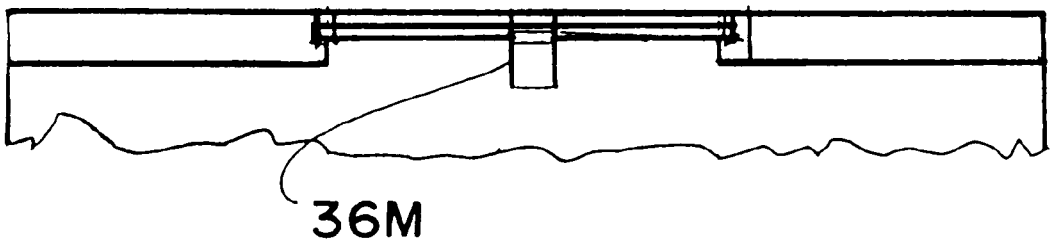
FIG. 19A

FIG. 30
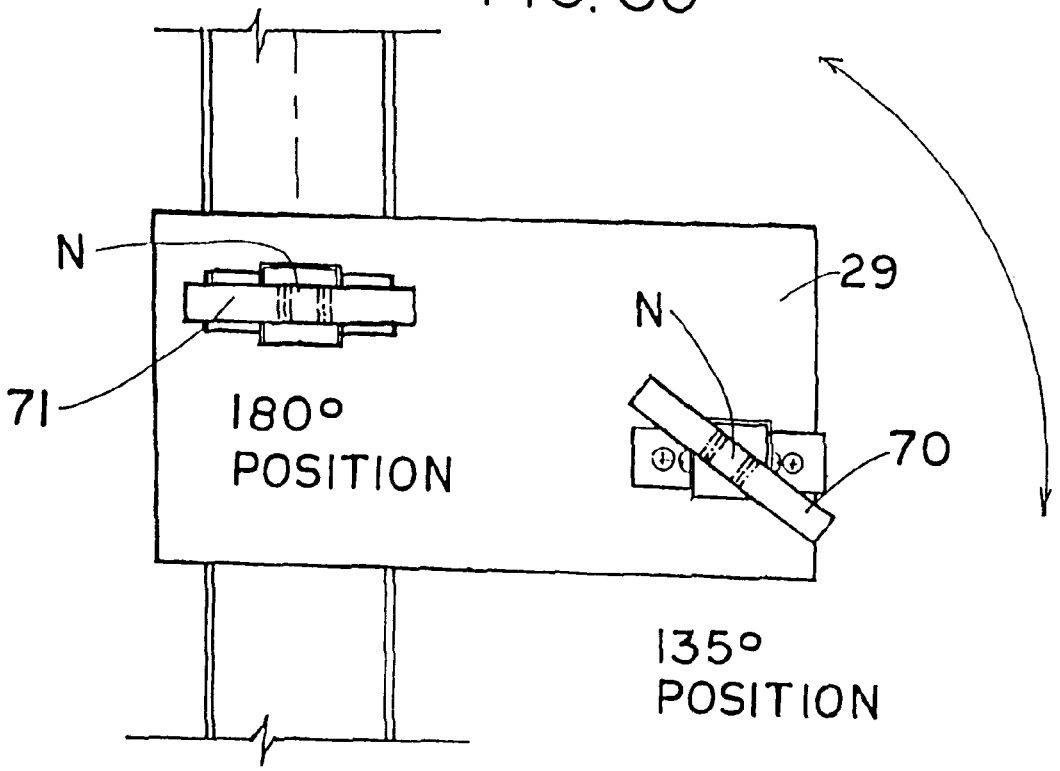
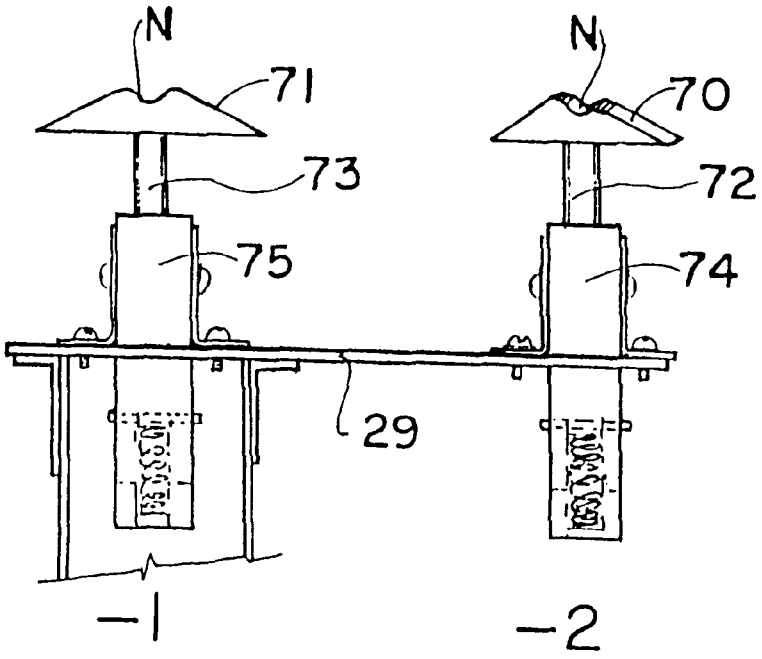
FIG. 31

BALL AS INTRODUCED INTO CARRIER 25C BY OPERATOR

BALL UNROTATED FOR A FOUR SEAM FAST BALL OR CHANGE UP

BALL UNROTATED FOR A SLIDER

BALL UNROTATED FOR A CURVE BALL

ROTATED CUT FAST BALL AND SINKER

*Fig. 37*

MAINTENANCE

- LOAD (UNLOAD) DATACARD
- SET DATE/TIME
- RECALIBRATE AXES TO HARDWARE LIMITS
- REALIGN TO HOME PLATE

MAIN MENU

*Fig. 45*

- SESSION/BATTER/PITCHER DATA
- PITCH SELECTION
- STRIKE ZONE SELECTION
- PITCH MODIFICATION
- VIDEO CAMERA CONTROL
- BEGIN PITCH SEQUENCE
- LOAD CAROUSEL
- LOAD (UNLOAD) DATACARD
- MAINTENANCE

SESSION/BATTER/PITCHER DATA

*Fig. 46*

- SESSION DATA
  - PITCHES PER SESSION ___
- PITCHER DATA
  - PITCHER: RIGHT HANDED OR LEFT HANDED?
- BATTER DATA
  - RIGHT HANDED OR LEFT HANDED?
  - KNEES: ___ Inches from Ground)
  - UNDERARMS: ___ (Inches from Ground)

PITCH SELECTION

*Fig. 47*

| PITCH TYPE | SPEED | PERCENT |
|---|---|---|
| 4SM FAST BALL | _____ | _____ |
| CUT FAST BALL | _____ | _____ |
| CURVE BALL | _____ | _____ |
| SLIDER | _____ | _____ |
| SINKER | _____ | _____ |
| CHANGE UP | _____ | _____ |

STRIKE ZONE SELECTION

*Fig. 48*

STRIKE ZONES INSIDE OUTSIDE

PITCH TYPE ZONES

| | 1 | 2 | 3 | 4 | % |
|---|---|---|---|---|---|
| 4SM FAST BALL | __ | __ | __ | __ | 100% |
| CUT FAST BALL | __ | __ | __ | __ | 100% |
| CURVE BALL | __ | __ | __ | __ | 100% |
| SLIDER | __ | __ | __ | __ | 100% |
| SINKER | __ | __ | __ | __ | 100% |
| CHANGE UP | __ | __ | __ | __ | 100% |

PITCH MODIFICATION

*Fig. 49*

PITCH TYPE (INCREASE OR DECREASE IN INCHES)

| | CUT | DROP |
|---|---|---|
| 4SM FAST BALL | _____ | _____ |
| CUT FAST BALL | _____ | _____ |
| CURVE BALL | _____ | _____ |
| SLIDER | _____ | _____ |
| SINKER | _____ | _____ |
| CHANGE UP | _____ | _____ |

VIDEO CAMERA CONTROL

*Fig. 50*

VCR CONTROL ON OR OFF
RECORD DURATION _____
INSERT TAPE
BE SURE:
* TAPE IS REWOUND
* TAPE'S RECORD LOCK IS OFF
TAPE DURATION _____

FIG. 51
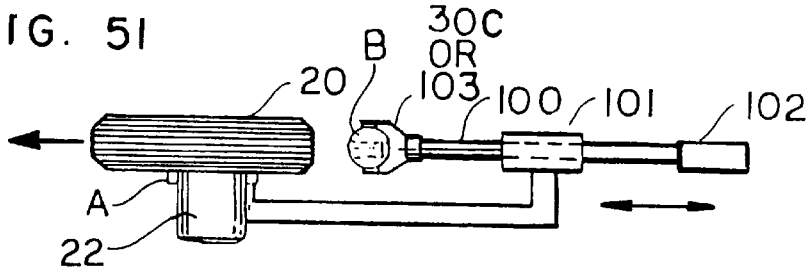
FIG. 52
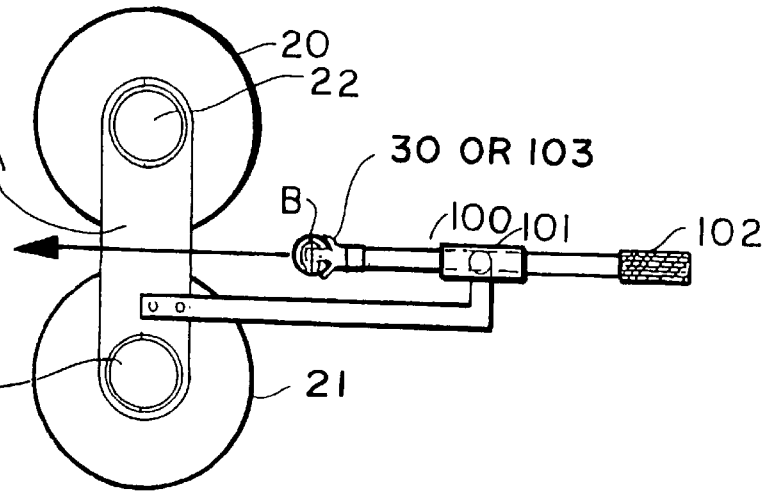
FIG. 53
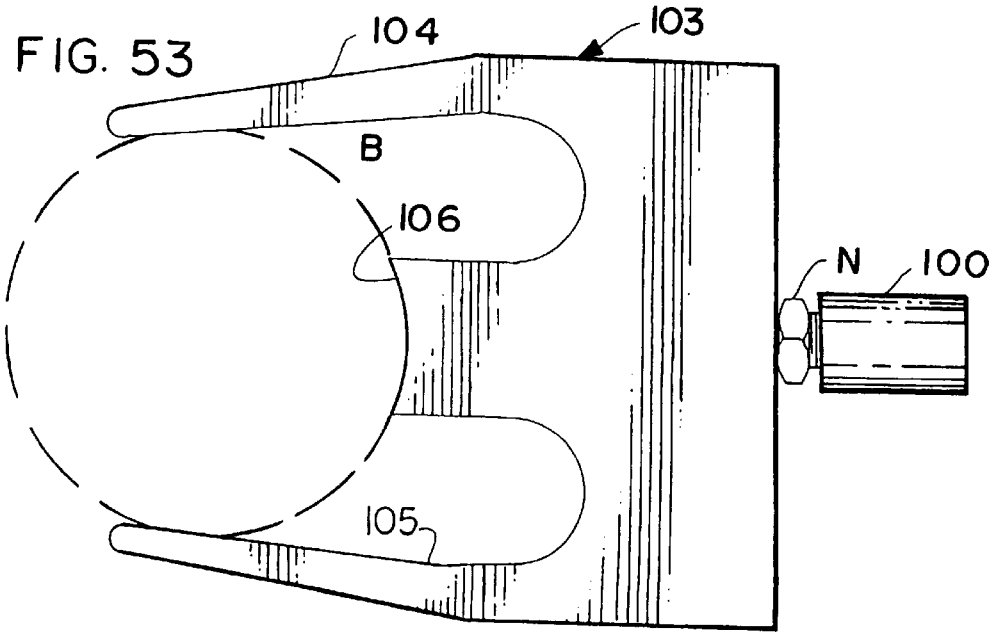
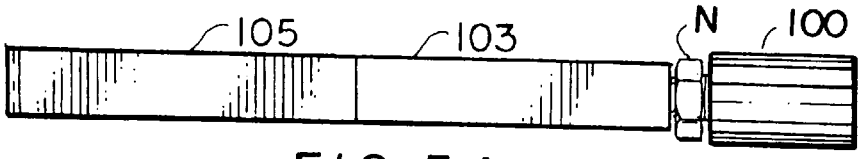
FIG. 54

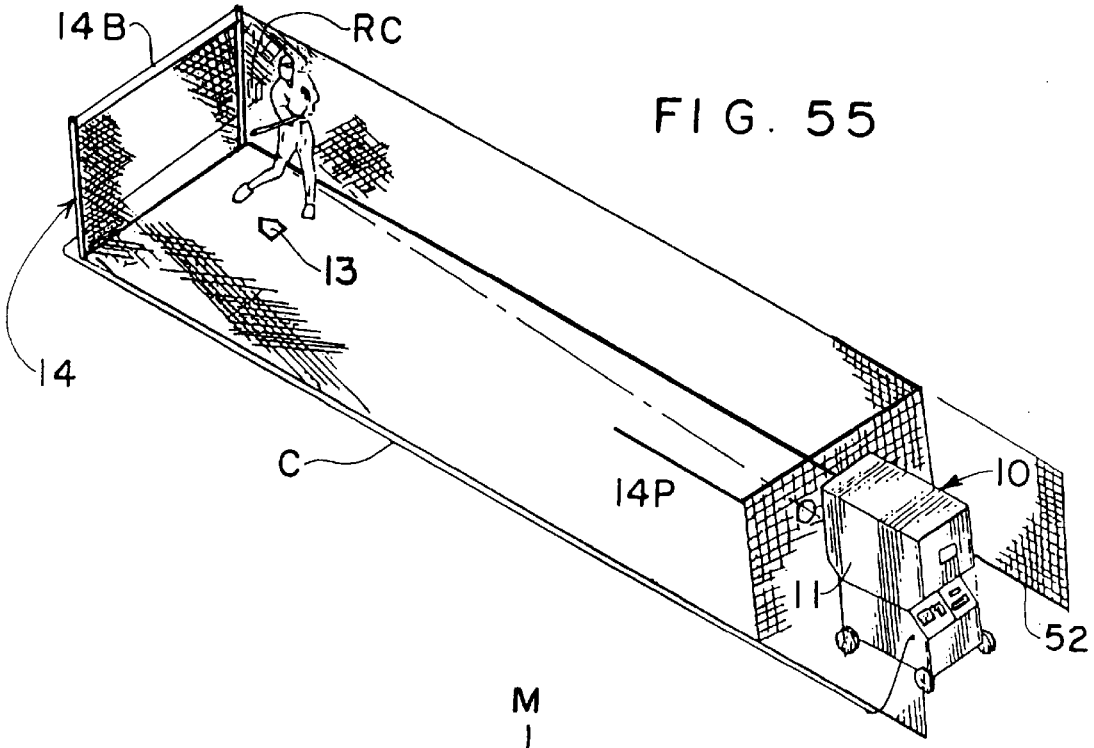
FIG. 55
FIG. 56
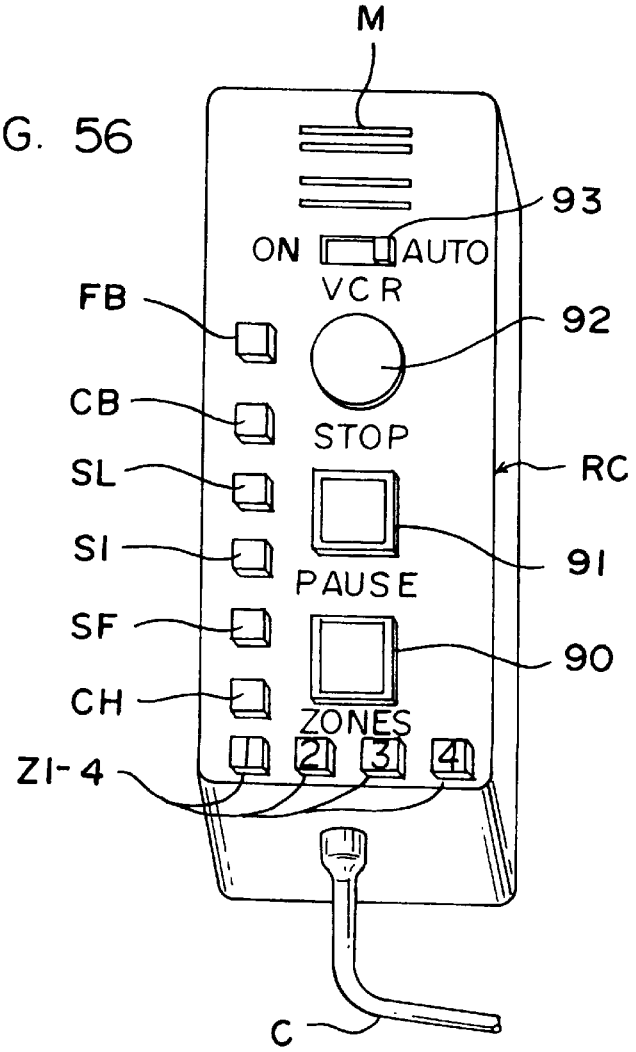

BASEBALL INSERTER FOR PITCHING MACHINES

This application is a continuation of Ser. No. 08/278,613 filed Jul. 21, 1994 abandoned.

BACKGROUND OF THE INVENTION

In the training of baseball players one of the most difficult tasks is to develop their batting skills at the plate. They must be trained to appreciate and use their existing visual acuity, they must improve their mental analysis of the game situation, they must enhance their memory of the opposing pitcher's abilities and tendencies, they must be able to thoroughly understand and follow their coach's directions, analyze each oncoming pitch and coordinate their own ability and muscle response, and combine them all within the matter of the fraction of a second of the early few feet travel of a pitched baseball arriving at a speed of 80 to 90 miles per hour.

Professional baseball players have demonstrated sufficient capabilities to meet the entrance standard for the professional world. However to maintain and enhance their abilities and to adapt them to new opposing pitchers, continuing training is essential. This is usually accomplished in the professional baseball world through the instruction of batting coaches with the help of warmup and training pitchers who throw pitches to batters in training and practice. The warmup and training pitcher does not have a happy lot. The work is tiring, uninspiring and, of course, the task is not allocated to game pitchers who must protect their arm. Therefore, batters in training or practice do not normally face the quality of pitcher that they face in every a league game.

Additionally, skilled coaches and scouts learn of the strengths, weaknesses, tendencies and habits of pitchers and batters which must be added to the coaching equation to bring a batter to their maximum skill level. For example, if a scout has ascertained that a particular pitcher generally throws a particular ratio or order of pitches, it is desirable to convey that information to a batter and, if possible, have the training pitcher throw such ratio or sequence in practice sessions before meeting that pitcher. It is extremely difficult to insure that a training pitcher has such skill and endurance to pitch reliably "on command" to train the batters effectively.

Similarly, the batting coach must recognize the strengths, weaknesses and habits of each batter and must build on the strengths, cure any bad habits and overcome the weaknesses often by requesting a series of identical pitches or a larger percentage of particular pitches from the training pitcher to instruct the batter. Few training pitchers can reliably pitch on command for sufficient time to effectively train a batter in one particular pitch.

Heretofore, baseball pitching machines have been primarily been found acceptable in the amateur and junior level of batter training and for that purpose they usually employ simulated baseballs lacking in seams which are utilized for control by major league pitchers. Most important, pitching machines, heretofore have not provided a realistic batting training session. Therefore, batting machines have not made any significant inroads into professional baseball training.

Various prior art pitching or ball launching machines have been developed through the years and the following exemplify the state of the art known to us:

| | | |
|---|---|---|
| 4,442,823 | Floyd et al. | April 17, 1984 |
| 4,269,163 | Feith | May 26, 1981 |
| 5,125,653 | Kovacs et al. | June 30, 1992 |
| 5,195,744 | Kapp et al. | March 23, 1993 |
| 4,197,827 | Smith | April 15, 1980 |
| 4,372,284 | Shannon | February 8, 1983 |
| 4,583,514 | Nozato | April 22, 1986 |
| 4,632,088 | Bruce | December 30, 1986 |
| 4,712,534 | Nozato | December 15, 1987 |
| 5,044,350 | Iwabuchi et al. | September 3, 1991 |
| 3,308,802 | Applegate | March 14, 1967 |
| 5,133,330 | Sharp | July 28, 1992 |
| 4,570,607 | Stokes | February 18, 1986 |
| 4,091,791 | Castelli et al. | May 30, 1978 |
| 3,989,245 | Augustine, Jr. | November 2, 1976 |
| 3,989,027 | Kahelin | November 2, 1976 |
| 3,838,676 | Kahelin | October 1, 1974 |
| 3,662,729 | Henderson | May 16, 1972 |
| 3,640,263 | Rhodes | February 8, 1972 |
| 3,288,127 | Bullock | November 29, 1966 |
| 5,012,790 | Bates | May 7, 1991 |
| 5,174,565 | Komori | December 29, 1992 |
| 4,784,107 | Kelly | November 15, 1988 |
| 4,815,735 | McClenny | March 28, 1989 |
| 4,548,407 | Sato | October 22, 1985 |
| 4,501,257 | Kholin | February 26, 1985 |
| German Patent | DE-3914017-A1 | |
| German Patent | DE-3407972-A1 | |
| Canadian Patent | 1-158-502 | |

We have, however, found that the counterrotating wheels of pitching machines do have significant merit in launching baseballs and minor degree of control of the pitch is presently possible with such ball launching systems. Examples of such counterrotating wheel ball launching machines are disclosed in the following patents:

| | | |
|---|---|---|
| 4,026,261 | Paulson et al | May 31, 1977 |
| 3,774,584 | J. K. Paulson | Nov. 27, 1973 |

These patents show that by controlling the relative speeds of two counterrotating wheels, that a spin can be imparted to a launched ball and that by changing the angle of the axes of rotation from horizontal that the spin imparted to the launched ball can cause it not only to drop but to curve to the left or right, as well.

Usually, smooth surface or, at least, non seamed balls are used with batting machines since contact of the seams of a baseball with the counterrotating wheels tends to produce erratic paths of the launched balls. Batting training using non seam balls is of virtually no value at the professional level since the seam position as it leaves the pitchers hand is of critical effect on the flight path producing the following pitches:

fast ball
curve
slider
sinker
cut fastball
change and a variety of specialty pitches of particular pitchers.

Of course, the effect and desirability of each of these types of pitches vary with left hand and right hand pitchers and left hand and right hand batters. An effective professional baseball quality pitching machine must be able to provide each of these pitches "on command" to be truly an effective training aid. Likewise the machine must effectively conceal from the batter, until delivery, the pitch being thrown so that the batter can only judge the pitch from the characteristics of the approaching ball. If a batter can master a pitching machine which can conceal the delivery operations, it can improve his skills to the level exceeding that required of a batter at the plate in an actual game where he has the additional clues from the pitcher's delivery and habits.

Furthermore, it would be of great advantage to the batter and to his coach to be able to view and analyze numerically the batter's performance in a batting training session, after the fact.

BRIEF DESCRIPTION OF THE INVENTION

Faced with the state of the art as described above, we set out to design a truly professional baseball quality batting training machine which will have the following features:

1. provide realistic pitches of the types normally encountered by a professional player at the plate;

2. employ regulation professional league baseballs;

3. provide precise control of the pitches;

4. provide repeatability for the same commanded pitch, time after time;

5. be usable by both left and right handed batters by a simple selective control;

6. simulate either a left or right hand pitcher pitching to either a left hand or right hand batter by a simple control;

7. to provide for selected sequence of pitches as the coach may desire;

8. to provide for a selected ratio of pitches as a coach may desire with the pitches being thrown on a random or predetermined basis;

9. to provide for pitches to reach the plate in selected zones;

10. to provide for pitching balls (non strike zone) on command or in a predetermined ratio;

11. to provide for batter safety through precise control of ball delivery;

12. to provide for selected speed of delivery from 60 to 90 miles per hour;

13. to provide for delivery to the target of a designated pitch as a percentage of a series of pitches;

14. to provide for precise azimuth control and spin axis accuracy to provide for precise delivery;

15. to be no more affected in the delivery from baseballs of different condition than a live pitcher encounters in an actual game situation;

16. to provide controllable pitching rate which is independent of the pitch sequence, along with the date, time, pitch type, pitch location and batter to record the training session and to allow the supplement of the batters performance on the record by the machine operator;

17. to provide a means of filming each pitch and the batter's reaction and to provide a record on the film of the pitch commanded, date, time, pitch type, pitch location and batter to allow post training analysis by the batter and his coach;

18. to provide for a coherent light source to provide a visual indication at the home plate of the orientation of the baseball delivery system;

19. to provide for a seam orientation system to insure that each baseball as delivered to the counterrotating wheels has the precise required seam orientation for correct delivery; and 20. to provide a ball inserter for holding a baseball with precise desired seam orientation for inserting a baseball into other delivery systems to produce predictable pitches with authentic standard baseballs.

Each of these objectives are accomplished in accordance with this invention in a machine employing counterrotating wheels or other delivery system including means for controlling the following parameters of the delivery system:

a) speed of delivery of the ball;

b) spin imparted to the ball on delivery;

c) axis angle of the delivery system;

d) seam orientation;

e) variable sequence in pitches not observable by the batter before delivery;

f) programming capability to provide different pitch patterns corresponding to opposing pitchers;

g) the batter's strike zone; and h) provides for calibration for the particular location of the pitching machine.

Where a counterrotating wheel delivery system is used, the speed of delivery is determined by the speed of the wheels and the spin imparted to the ball is a function of the relative speeds of the two wheels at the instant of delivery and the axis angle. The trajectory of the baseball is a function of the azimuth, elevation and axis angle adjustments of the delivery system and the seam orientation, as well as the relative and actual speed of the wheels.

In accordance with our invention, we employ a ball prepositioning subsystem requiring a standard original position for the seams along with a ball rotating means for rotating the ball in two axes to present the baseball to a ball inserter with the seam orientation appropriate to the pitch commanded.

We provide a control panel and a computer which cooperate to allow input commands which:

1. align up the pitching machine to the target plate;

2. calibrate the ball motion controls consistent with the machine alignment;

3. adjust for the handedness of the pitcher and the batter;

4. adjust for the batter's strike zone and the desired pitch sequence for this batter;

5. select the ball trajectory options and modifications of pitches selected;

6. select the number of each particular type of pitch in each series of random pitches;

7. control a video camera to record the batter's actual performance for each pitch; and 8. count the pitches of each series.

We also provide for a remote control locatable at a coaching position near the plate for control by a batting coach.

BRIEF DESCRIPTION OF THE DRAWING

This invention may be more easily understood from the following detailed description and by reference to the drawing in which:

FIG. 1 is a perspective view of a batting cage employing the pitching machine of this invention shown in a calibration mode;

FIG. 1A is a front elevational view of a layout of the strike zone for a right handed batter and the designations as used in this invention;

FIG. 2 is a right side elevational view of the pitching machine of FIG. 1 with the right side panel removed;

FIG. 3 is a front elevational view, thereof as viewed by the batter;

FIG. 4 is a rear elevational view thereof as viewed by the machine operator;

FIG. 4B is an enlarged plan view of the keyboard of the control panel of this invention;

FIG. 13 is a side elevational view of a wheel spin axis adjustment drive motor assembly;

FIG. 14 is a fragmentary top plan view of the ball positioner assembly of this invention;

FIG. 15 is a rear elevational view of the ball positioner of this invention;

FIG. 16 is a side elevational view of the ball positioner of FIGS. 14 and 15;

FIG. 19 is elevational view from the interior of the machine housing showing the ball exit door;

FIG. 19A is a fragmentary horizontal sectional view of the door assembly taken along line 19A of FIG. 19;

FIG. 30 is a top elevational view of carousel positioning assemblies of this invention;

FIG. 31 is a side elevational view of the carousel positioning assemblies of FIG. 30;

FIGS. 45 through 50 and FIG. 37 are typical screen presentations as seen by the operator of the pitching machine of this invention;

FIG. 51 is a top plan view of a manual ball inserter in accordance with this invention employed with a conventional counterrotating ball launcher;

FIG. 52 is a side simplified elevational view of a conventional counterrotating wheel ball launcher employing the manual ball inserter of FIG. 51;

FIG. 53 is a top plan view of the ball gripper of FIGS. 51 and 52; and FIG. 54 is a side elevational view thereof;

FIG. 55 is a perspective view of an embodiment of this invention including remote control features; and FIG. 56 is a perspective view of a remote control for use in the embodiment of FIG. 55.

DETAILED DESCRIPTION OF THE INVENTION

Figure 4A:
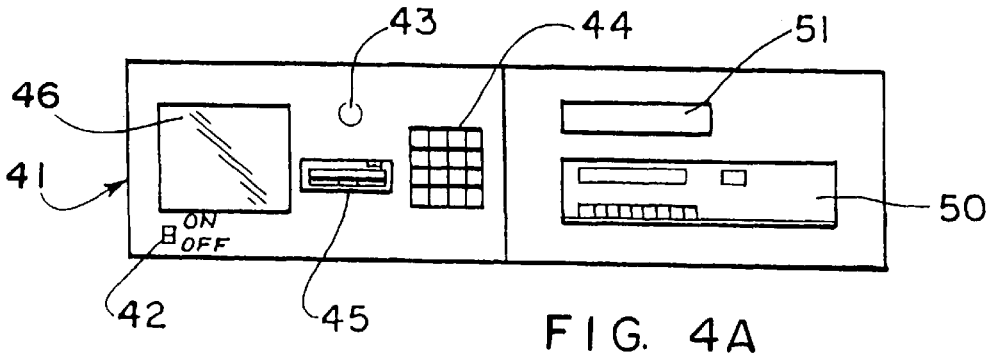
FIG. 4A is an enlarged elevational view of the control panel of the pitching machine of FIG. 1.

The pitching machine of this invention is basically a self-contained system 10 as shown in FIGS. 1–4, in a housing 11 and mounted on wheels 12 to be moved into a training position in a batting cage or on an actual playing field either of which includes a plate 13 shown with a reflective material calibration and alignment target 13A temporarily in place on the plate 13. A protective screening system, generally designated 14, is shown including a backing screen 14B and a protective screen 14P for the machine 10 including a hole for allowing pitched balls to reach the plate 13 but capturing nearly all batted balls. The pitching machine 10 is located at the standard distance from mound rubber to the plate 13 and calibrated as described below to deliver strike pitches into the four zones 1–4 as shown in FIG. 1A and ball pitches, as well, outside of the strike zone which is defined generally by the imaginary target 15 of FIG. 1A.

In professional batting training, the full strike zone is not used. Therefore, the crosshatched area of the strike zone of FIG. 1A is not part of the normal pitch routine but is within the capability of the machine 10 and pitches may be delivered to this zone, as well.

Now referring specifically to FIGS. 2 through 6 wherein the basic elements of this invention as viewed from various directions, may be seen. It is apparent, in FIGS. 2 and 5, with the side of housing 11 removed, that the pitching machine 10 employs a pair of counterrotating wheels 20 and 21, each driven by their respective motors 22 and 23 at precisely controllable and variable speeds. At the right-hand side (front or ball delivering side) a third motor 28 may be seen in FIGS. 5 and 13, with its speed reduction gear box 28G and coupler 28C driving the spin axis shaft S of the machine 10. The shaft S is journaled by a pair of pillow blocks PB of FIG. 5. The pillow blocks PB are secured to the ends of the arms of a gimbal G may also be seen in FIG. 13.

Figure 43:
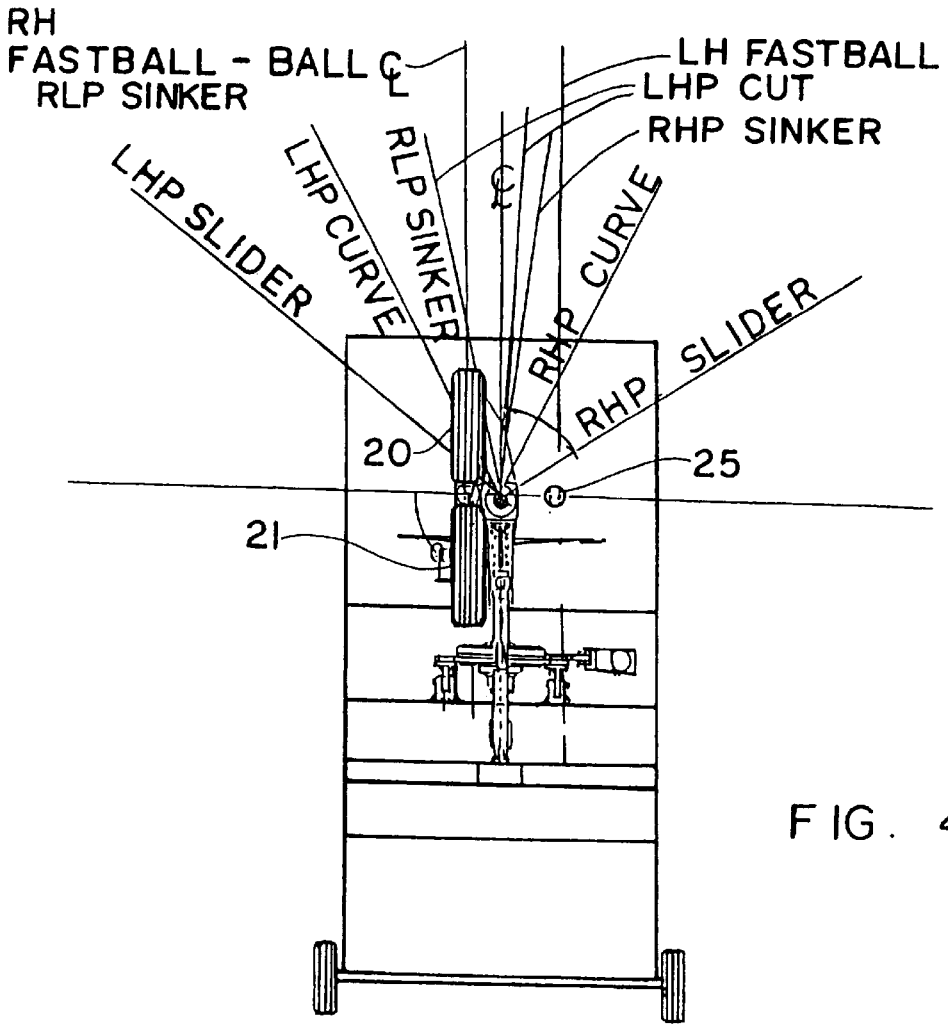
FIG. 43 is a front elevational view of this invention with the spin axis angles or rotation for each type of pitch illustrated.

The shaft S defines the axis of the spin imparted to a baseball which is launched by the counter rotating wheels 20 and 21 after insertion between the adjacent "tread" surfaces of the wheels 20 and 21. The wheels 20 and 21 have air inflated tires at a pressure in the order of 16 psi and with a normal spacing less than the diameter of a standard baseball to launch the baseball in the direction of the heavy arrows in FIGS. 2 and 5. The spin axis of the machine 10 is best illustrated in FIG. 43 at the apex of the intersecting lines denoting different spin angles for the wheels 20 and 21 for seven different pitches. The wheels 20 and 21 with their respective motors 22 and 23 are supported for rotation about the spin axis by the same rotating arm A of FIG. 5.

Figure 5:
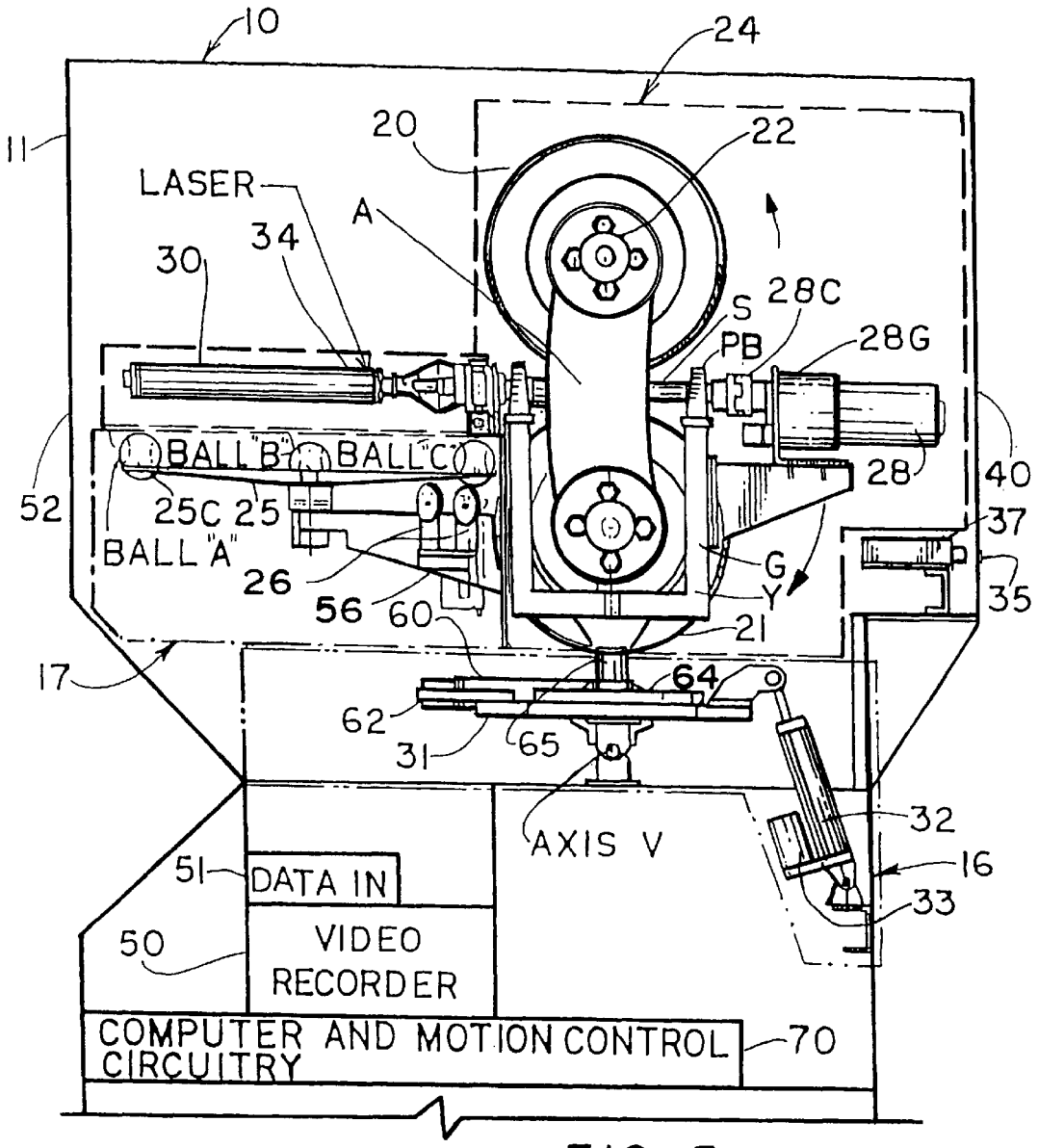
FIG. 5 is an enlarged right side elevational view with the right side panels removed.

The ball launching assembly, generally designated 24 is indicated in FIG. 5 by the dashed line includes not only:

a) the wheels 20 and 21 and their motors 22 and 23; but also b) a ball inserter 30 of FIGS. 5 and 38–40.

Each of these members of the ball launching assembly 24 are supported on and rotate about the spin axis on shaft S which is in turn supported by the gimbal G.

Referring again to FIGS. 2 and 5, a laser beam generator 34 is mounted on the ball inserter assembly 30 and directed to emit a precise beam through a ball launch opening 40 in the front face of housing 11. A video camera 37 is mounted on the housing 11 and views the batter and plate 13 through opening 35 of FIG. 3.

Referring now briefly, to FIG. 19, the ball exit opening 40 of the housing 11 is normally closed by a door 35 which is opened and closed by a cable system 36 under the control of the machine computer 70, described below. The cable system includes cables 36A and 36 B, takeup drum 36D and drive motor 36M. The door 35 is positioned against the wall of the housing 11 by guide rails 38 and may be held up for maintenance purposes by manual latch 39 Suffice it to say, the door 35 remains closed except during the actual pitch cycle, opening just before a pitch is launched and closing again before any pitched ball, hit by the batter, might reach the opening 40. From the training aspect, the presence of the door 35 also prevents the batter from observing any portion of the pitching apparatus which might give him a clue to the next pitch.

Figure 10:
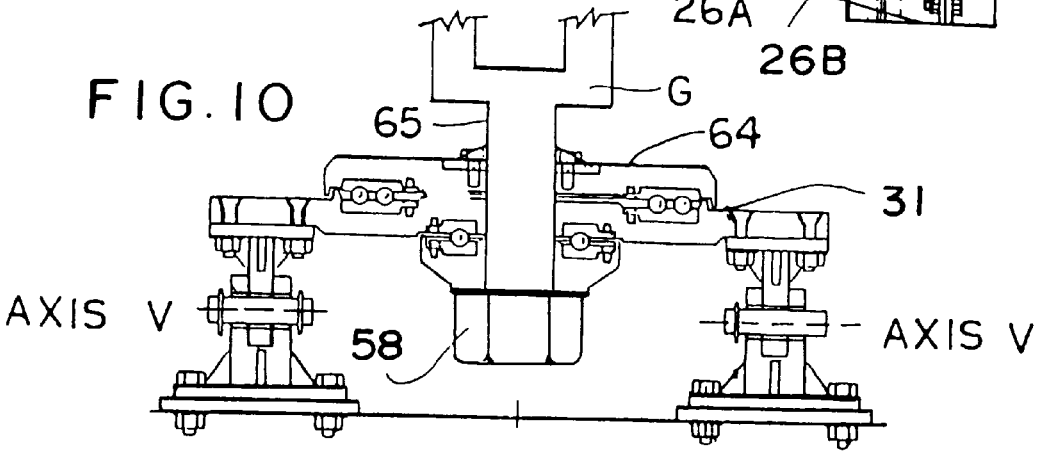
FIG. 10 is a side sectional view, partly in section of the gimbal support and orienting mechanism of the pitching machine of FIG. 1.

Referring again to FIG. 5, the baseball launching assembly 24 is not only rotatable about the spin axis of shaft S but, via the gimbal G, is mounted on a tiltable platform 31, best seen in FIG. 10 and which is rotatable about an elevation or V axis under the control of a linear actuator 32 of FIG. 5 and driven by servo motor 33.

The baseball delivery mechanism 24 is also tiltable about a second or azimuth axis AZ by a second linear actuator 60, largely concealed in FIGS. 2 and 5 but best shown and described below in connection with FIGS. 6 and 12.

PRIMARY OPERATING CONTROLS

From the operator's standpoint, the primary operating position is behind the pitching machine 10 where all operating controls are located as shown in FIG. 4. Now referring specifically to FIGS. 4 and 4A, the control panel 41 includes a power ON/OFF switch 42, an interrupt switch 43, a keypad 44, a data card input slot 45 and a monitor screen 46 on which the operating menus of FIGS. 45 through 50 are displayed for the operator's guidance.

Other controls available at the rear side of the machine 10 are on a commercially available video recorder 50 which is used to record the training session, if desired, and a data inserter 51. The data inserter 51 is any one of the commercially available devices used to allow the addition of titles and other data, received from the computer output, superimposed upon a video image as recorded on conventional video recorders. In this case, data regarding the batter, the pitch sequence or the pitcher to be emulated may all be superimposed as a title or subtitle on the scene so that the training session may be analyzed after the fact by both the batter and his coach with clear identification of all important facts. Each individual pitch as commanded by the computer control is identified on the video tape so that the batter has the opportunity and requirement to analyze it on the video record. He can also see his own performance from the pitcher's position and in response to each pitch. As a training aid the presence of the camera and recorder is invaluable.

The rear of the housing 11 also includes a wide opening 52 which is used by the operator to place baseballs B on a carousel 25 of FIGS. 5–9 or 17, for launching.

BASEBALL RECEIVING, SEAM ORIENTING AND POSITIONING SUBSYSTEM

Figure 8:
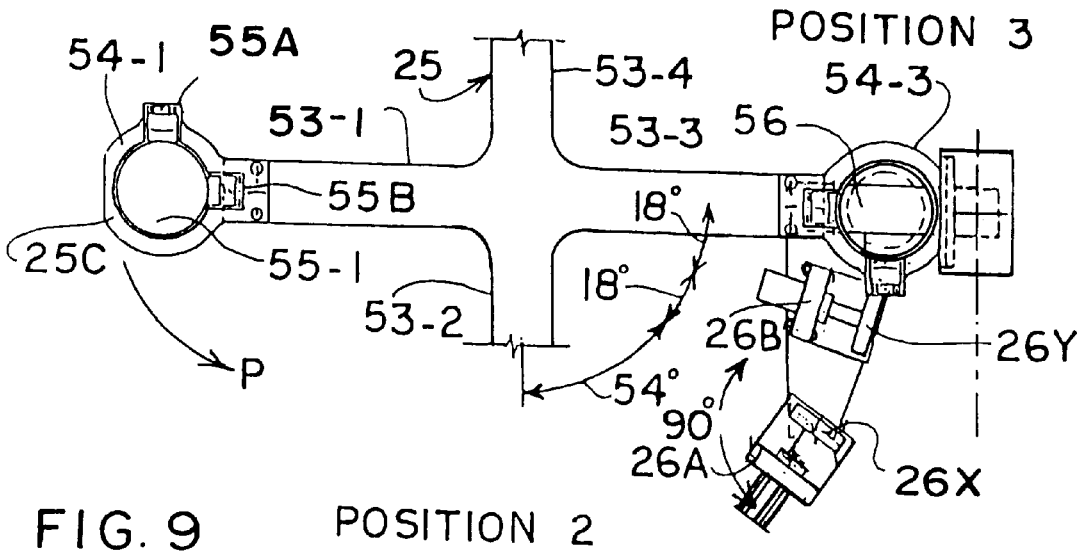
FIG. 8 is a fragmentary top plan view of the ball transportation in carousel and ball seam positioners of the pitching machine of FIG. 1.
Figure 9:
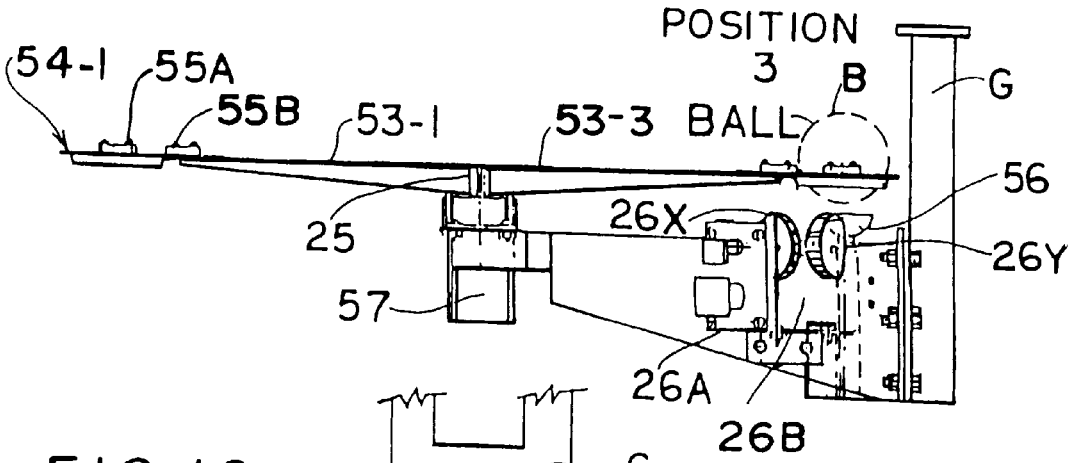
FIG. 9 is a side elevational view of the carousel and ball seam positioners of FIG. 8.
Figure 17:
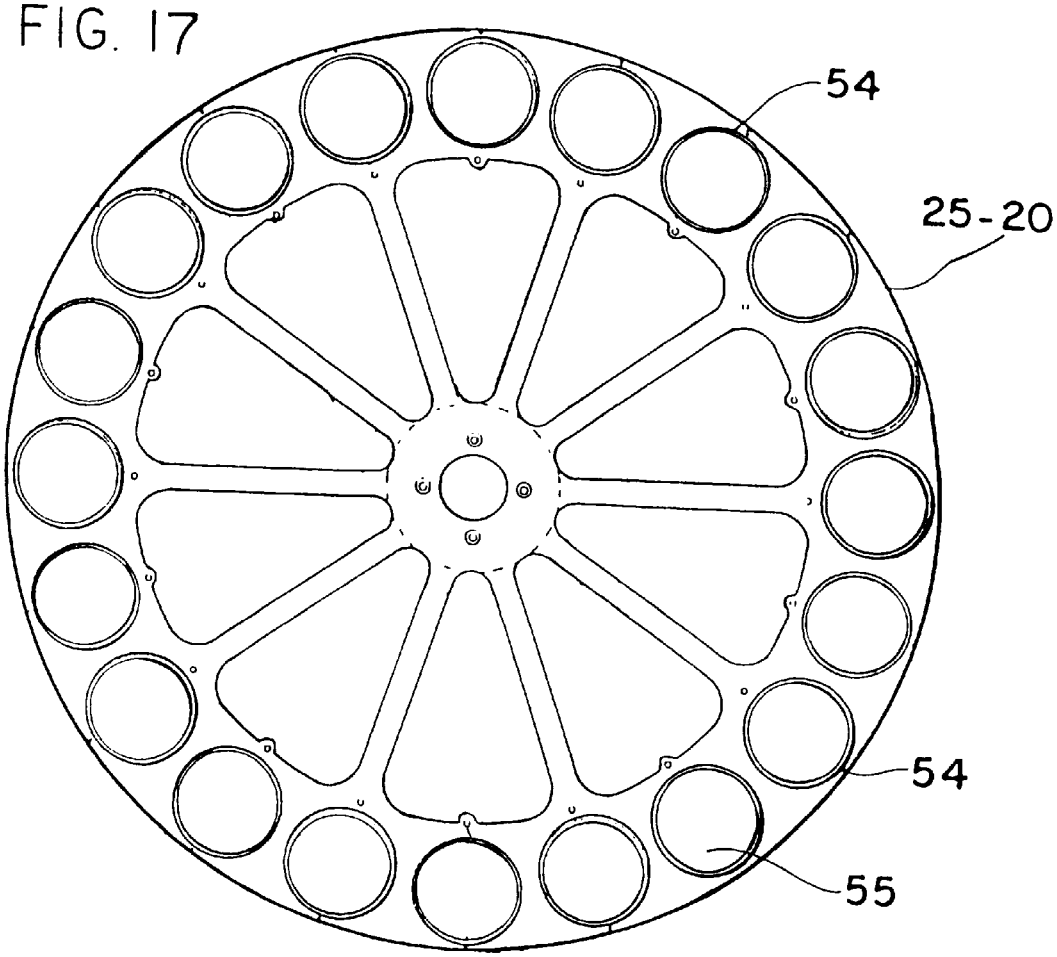
FIG. 17 is a top plan view of an alternate form of the carousel to use in this invention.
Figure 18:
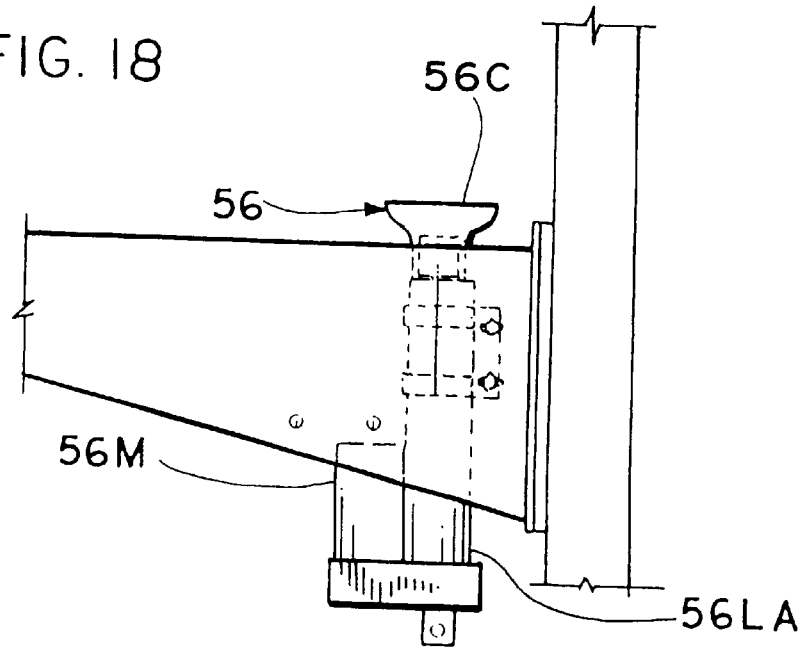
FIG. 18 is a side elevational view of the ball lifter of FIGS. 5 and 9.

Now, refer to FIGS. 8 through 10 in conjunction with FIG. 5 for more complete understanding of the ball receiving, seam orienting, and positioning subsystem 17 of this invention which is generally designated 17. This subsystem 17 is indicated in the drawing, FIG. 5 by the dash-dot outline and includes:

a) a carousel 25 of FIG. 8 and 9 or 17 for receiving and transporting baseballs;

b) a pair of baseball seam rotators 26A and 26B of FIGS. 8, 9, 41 and 42;

c) a ball lifter 56 of FIGS. 5 and 18A; and d) a ball orienter 27 of FIGS. 14–16.

The input to this subsystem 17 is through the opening 52 of the housing 11 for the operator to place baseballs on the carousel 25. The carousel 25, best seen in FIGS. 8 and 9 having a number of identical arms 53, four for example, 53-1 through 53-4, two of which are shown in full in FIG. 8. As many as 20 ball receptacles may be used to provide a full series of 20 pitches. Such a 20 cup carousel 25–20 appears in FIG. 17 with the cups at 18 degree angular separation. In the case of either the four cup or 20 cup carousel, each has an end cup or carrier 54 with a central opening 55 and a pair of contoured rollers 55A and B to facilitate seam rolling movement of the baseball in the carousel 25. Access to the surface of the baseball is available below the carriers 54, through the opening 55 which is used for seam orientation by cam surfaces as described below and for lifting out of the carriers 54, by the ball lifter 56 of FIGS. 5 and 18. When lifted out of the carrier 54 by the ball lifter 56, the baseball B is available for grasping by the jaws 30D of the ball inserter 30 of FIGS. 5 and 38–40 for insertion between the wheels 20 and 21.

As best seen in FIG. 9, the carousel 25 is supported on the shaft of a stepper motor 57 with an integral gear reduction unit driven in angular increments of, for example, 18 degrees, by the stepper motor 57. The carousel 25, and motor 57 are all mounted on the gimbal G along with two seam rotators 26A and B, each at one of the incremental advances. In this embodiment, the seam rotator 26A is located at the 135-degree position where the 0 degree or position 1 of the carousel 25 is at the opening 52. The seam rotator 26B is located at the 165-degree location. These locations for the seam rotators 26 are chosen, mainly, toward the end of the baseball travel and for non interference with each other and with the ball lifter 56.

AZIMUTH AND ELEVATION ADJUSTMENT SUBSYSTEM

Figure 11:
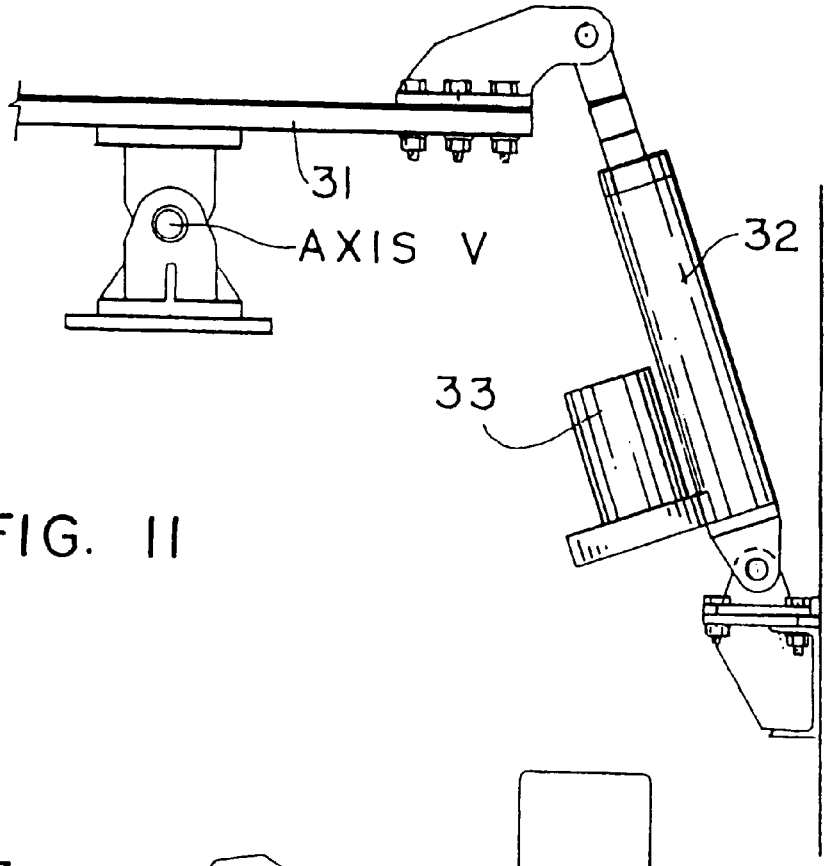
FIG. 11 is a side elevational view of the elevational angle adjustment mechanism of the pitching machine of FIG. 1.

Referring again to FIG. 5 in combination with FIGS. 6, 10, 11 and 12, two degrees of motion is introduced into the gimbal G and the spin axis shaft S via a platform 31 which is pivotally secured to the frame of the machine 10 at axis V of FIGS. 5 and 11. This azimuth and elevation adjustment subsystem is generally designated 16 in FIG. 5 and outlined by the dot-dash-dot outline. The maximum elevation angle about axis V is UP 10 degrees and DOWN 5 degrees.

Figure 7:
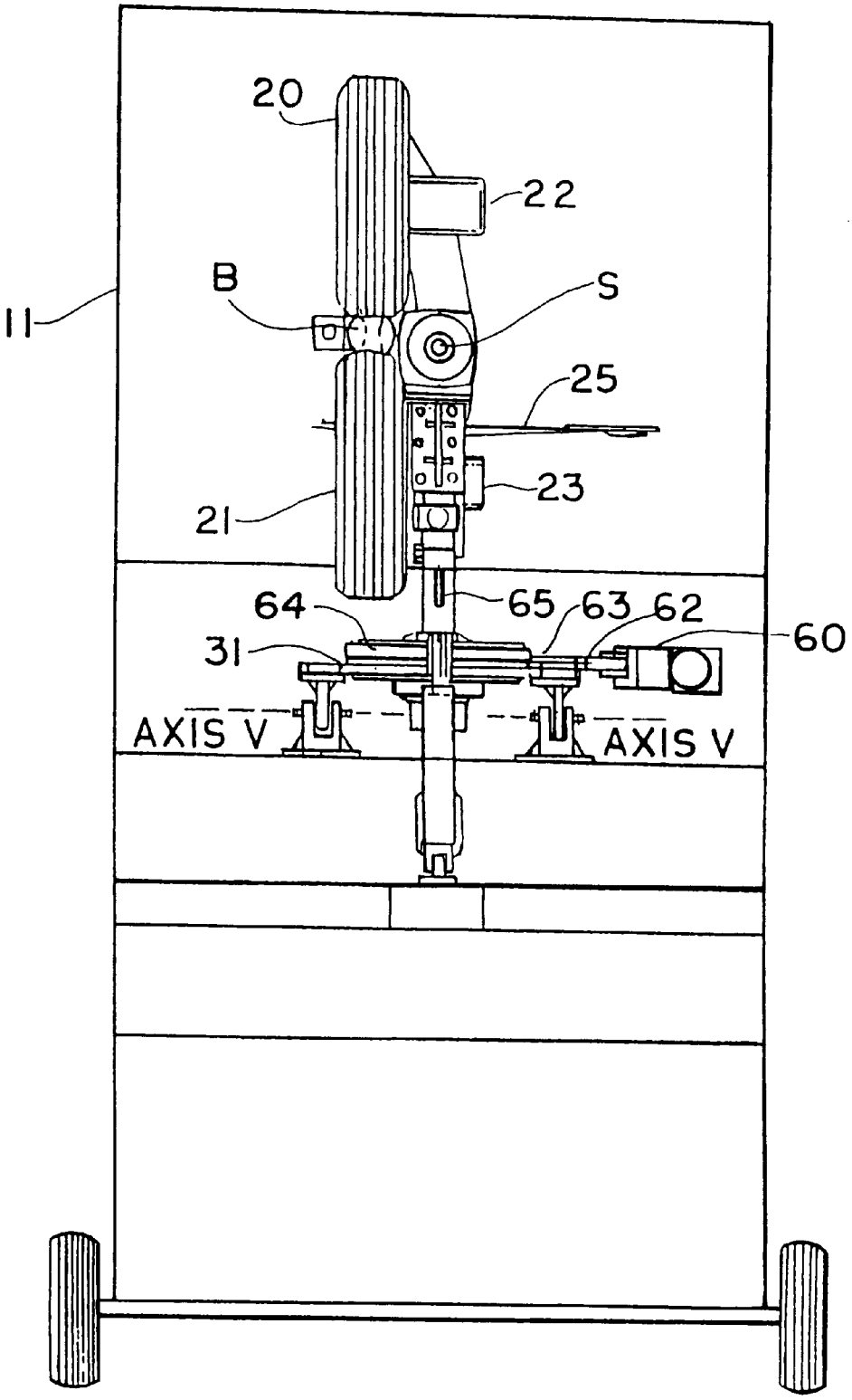
FIG. 7 is a front elevational view with the front top panel removed.

The orientation of axis V, as well as, the relative positions of the wheels 20 and 21, the carousel 25 and the tiltable platform 31 are apparent from FIG. 7 which is a batter's side view with the front face removed.

Figure 6:
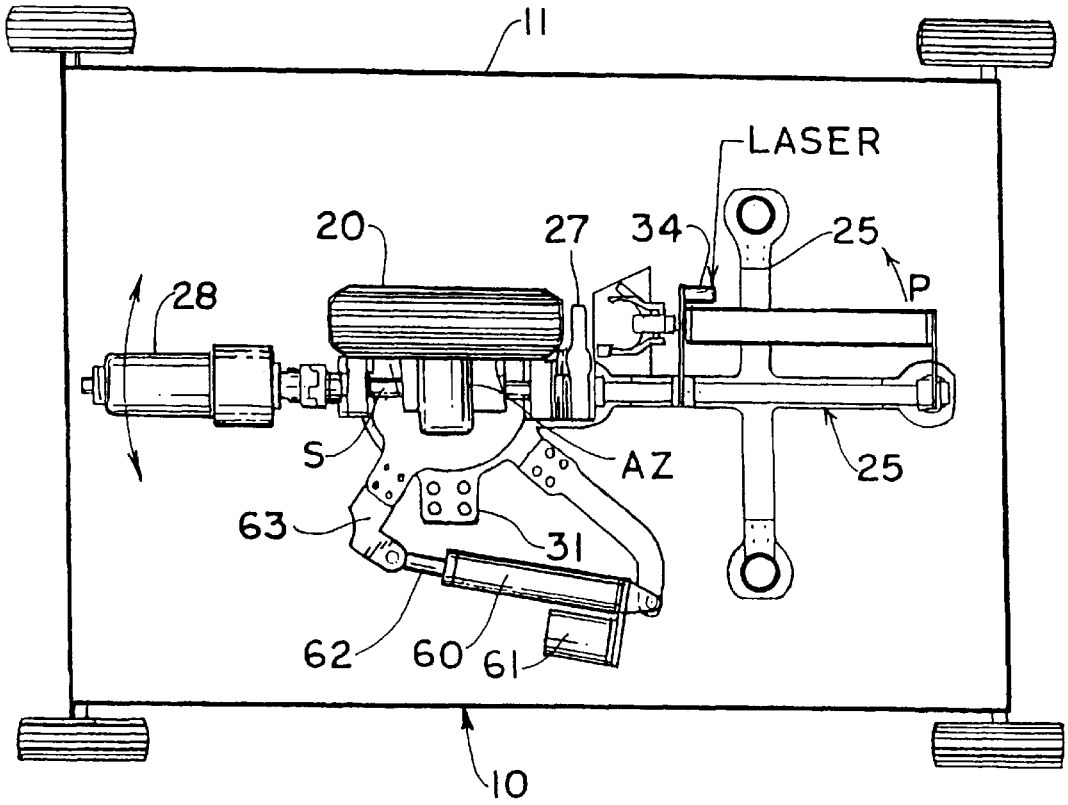
FIG. 6 is a top plan view thereof with the top cover removed.
Figure 12:
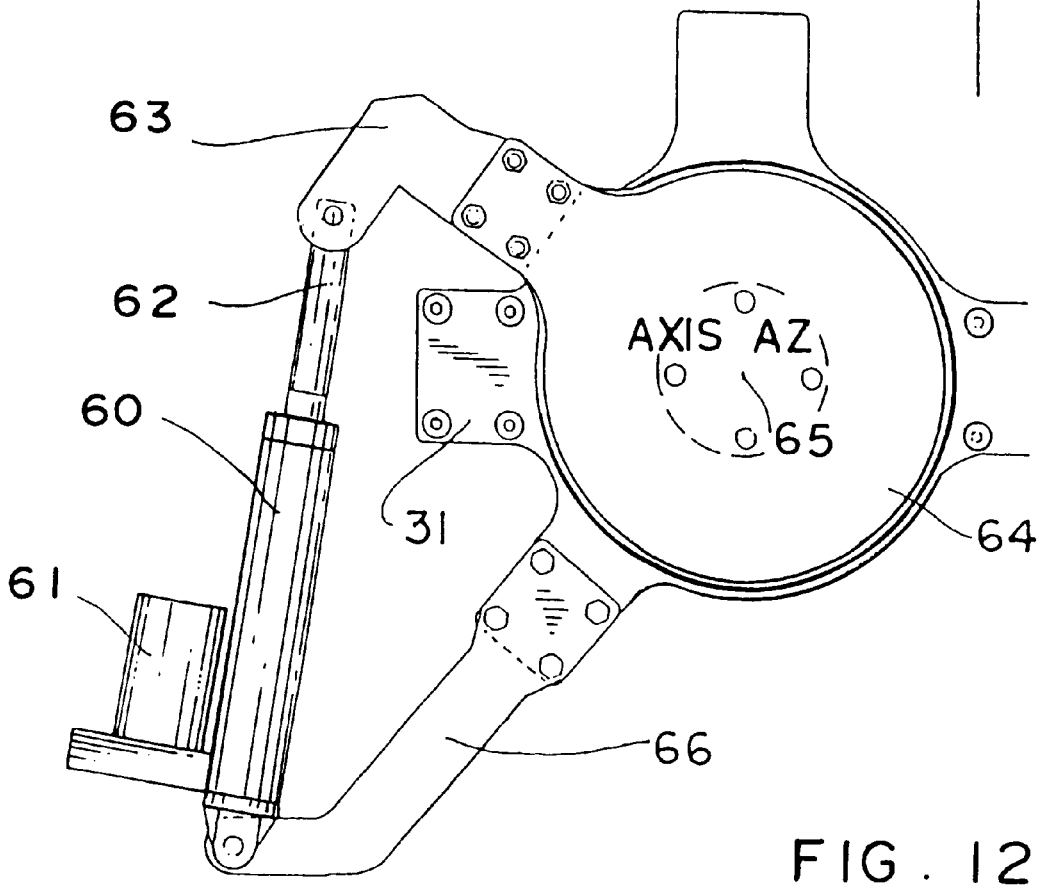
FIG. 12 is a top plan view of the horizontal sweep angle adjustment mechanism of the pitching machine of FIG. 1.
Figure 44:
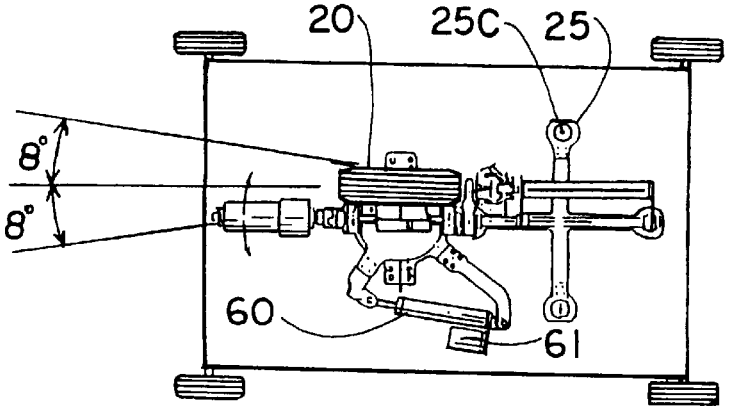
FIG. 44 is a top plan view similar to FIG. 43 showing the wheel directional orientation for respective pitches of FIG. 43.

The second axis of tilt of the delivery system, axis AZ may be seen in FIGS. 6, 12 and 44, namely the azimuth angle of the wheels 20 and 21 is controlled about axis AZ by a linear actuator 60 driven by servo motor 61 so that its actuator rod 62 rotates arm 63 to rotate azimuth plate 64 mounted of platform 31 all shown in FIG. 6. The azimuth plate 64 carries the support standard or gimbal post 65 for the entire baseball launching assembly and thereby allows the introduction of azimuth changes to the direction of baseball launching. The angular orientation of the post 65, gimbal G and the wheels 20 and 21 is precisely determined by the linear actuator 60 pivotally connected to arm 66 of the tiltable plate 31 along with positional feedback circuitry which insures the accuracy of the line of flight as precisely as + or −¼ of one degree.

The variable launch directions may be seen in FIG. 44. The two stepper motors 33 and 61 are under the control of the computer and motion control circuitry which is generally designated 70 in FIG. 5.

OVERALL OPERATION

Figure 32:
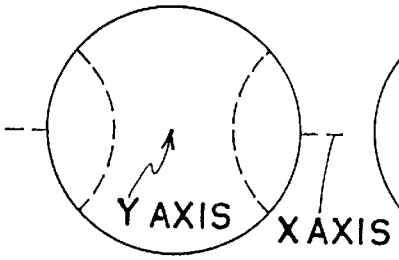
FIGS. 32 through 36 are plan views of the seam positions for various pitches delivered by the pitching machine of this invention.
Figure 33:
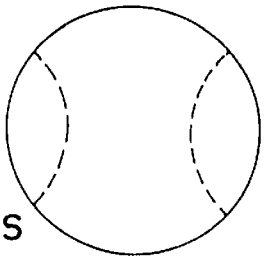
Figure 34:
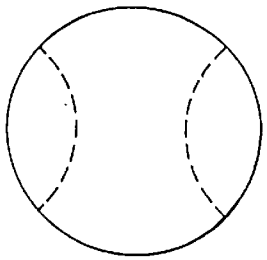
Figure 35:
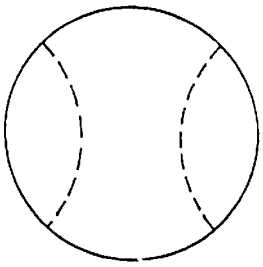
Figure 36:
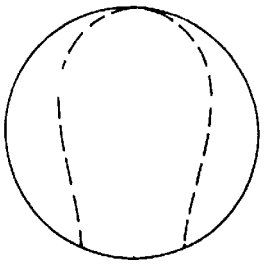
Figure 38:
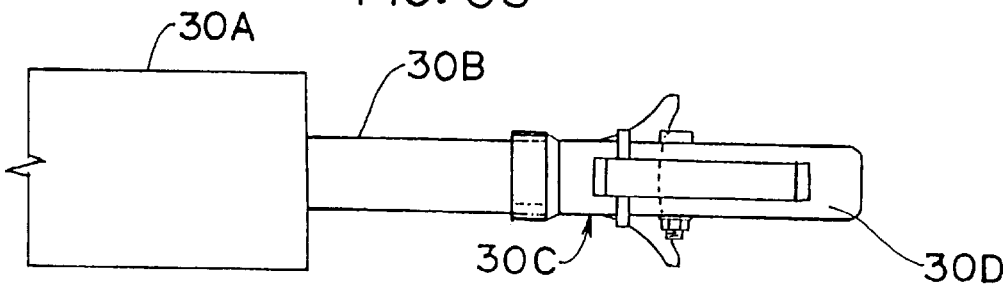
FIGS. 38, 39 and 40 are side, front and top views, respectively of the ball inserter gripper head of this invention.

The features of this invention which allow for precise control and repeatability of each selected pitch are illustrated in FIG. 5 in connection with FIGS. 8 and 9 when reviewed in conjunction with the flow diagram of FIGS. 22–26 and FIGS. 41 and 42. This is illustrated in FIG. 5 and identified in that figure by the dashed line outline. As described in more detail below, in connection with FIGS. 8–10 and illustrated in FIG. 32, the operator places the baseball B in the cup 55-1 of the adjacent arm of the carousel 25 in a standard orientation, that is, as shown in FIG. 32. The operator advances the carousel 25 by the ENTER command via the keyboard. Thereafter, as the carousel 25 is rotated to the next position (90 degrees in the case of a four-arm system or 18 degrees for the 20 cup version), from position 1 to position 2 during the time that a baseball at position 3 or 11 is launched. Between positions 2 and 3 the baseball B is rotated about one or two orthoginal axis to move the seams to the correct position for the pitch commanded.

SEAM ROTATION

Figure 41:
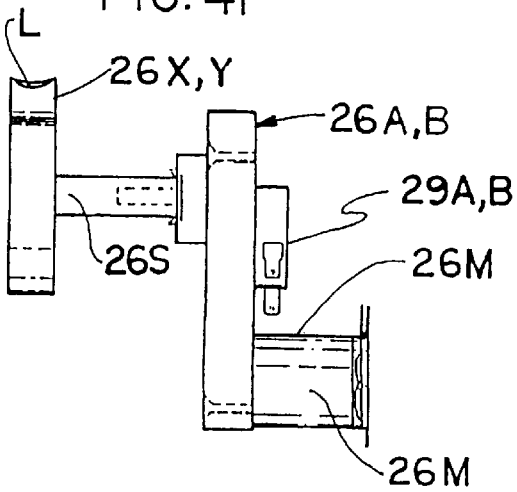
FIGS. 41 and 42 are side and front elevational views, respectively of the ball seam turning mechanism of this invention.
Figure 42:
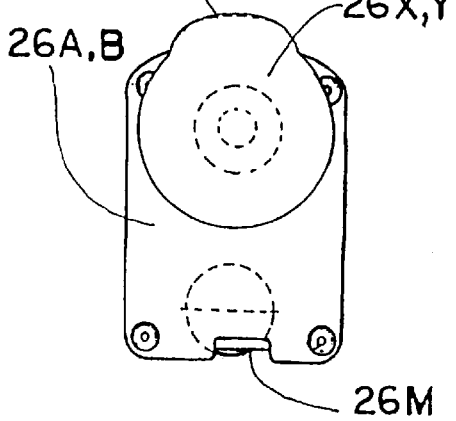

In FIGS. 8 and 9 and in more detail in FIGS. 41 and 42, two identical ball seam rotator or seam alignment mechanisms 26A and 26B are shown, each having a rotatable cam surface 26X and 26Y which bear against the underside of the baseball B causing the baseball B to roll, first for X axis orientation and next in the Y axis while in the carousel 25 and moving from the 90-degree position to the 180-degree position in the pitching machine and then ready for lifting by ball lifter assembly 56. The cams 26X and Y are shown in FIGS. 41 and 42, each have a single lobe L which is oriented and of sufficient height to make the required angular rotation in each of the X and Y axes as represented in FIGS. 32–36. The cam surfaces 26X and Y are rotated on respective shafts 26S by respective motors 26M while travel is limited by microswitches 29A or B.

During seam rotation in each axes, the arms of carousel 25 temporarily rest in notches N, as shown in FIGS. 30 and 31, of two upstanding ramp surfaces 70 and 71 mounted on spring loaded shafts 72 and 73 on respective tubular columns 74 and 7% on platform 29 which is a part of the carousel 25 support. These carousel arm holders 70 and 71 position the arms for precise rotation seam rotation of the baseball and precise positioning for baseball grasping by the baseball orienter 27.

For each of the pitches shown in FIGS. 32–36, ball rotation is required only above one axis, namely the X axis, so the Y axis cam 26Y may remain motionless and downward out of contact with the baseball B at all times for those pitches.

Baseballs B follow the circular arc path P of FIGS. 6 and 8 for seam orientation between the 90 degree and 180 degree positions. The baseballs B each rest lightly in the ring shaped carrier or carrier 25C of FIG. 5.

As the carousel moves in stepped advances through 90 degrees to Position 2 of FIG. 8, one carrier 54-3 is located in position 3 nearest to the wheels 20 and 21, the ball lifter 56 and the ball orienter 27. If a baseball B is on the carrier 54-3 in position 3 for the four armed embodiment or position 11 for the 20 carrier carousel 25 of FIG. 17, baseball B will be positioned to be raised by ball lifter 56, grasped by the jaws of the ball orienter 27 and inserted between the wheels 20 and 21 by the ball inserter 30.

For purpose of discussion, consider the baseball B just placed by the operator in the carrier 25C to be the first baseball of the training session. The carousel 25 advances incrementally to 90 degrees after the operator commands ENTER on the control panel and the baseball B, just loaded, is transported to Position 2. With the next ENTER command by the operator, the carousel 25 incrementally advances. During any rotation where a cup 55 is located at a seam rotator 26, a rib on the underside of the carousel arm rides up on the ramp 71, best seen in FIGS. 30 and 31 and stops momentarily in the notch N of FIG. 31. The carousel 25 is then aligned properly for ball seam rotation in the X axis. The baseball B is rotated by cam 26X about the X axis to the extent required in that axis for the pitch commanded. Continued rotation of the carousel 25 past the cam 26Y completes the rotation about the Y axis, if required, to the position shown in one of the FIGS. 33 through 36 for the particular pitch of the sequence commanded by the operator.

We have found that for all of the standard pitches used, that no actual seam rotation about the Y axis is necessary. This is illustrated in FIGS. 32 through 36 in which no Y axis rotation from the input position of FIG. 32 is needed to reach the ball insertion position for each of the pitches noted. If a pitcher develops a unique pitch in which dual seam or axis rotation is used in his delivery, this pitching machine is ready to simulate the pitch. In the computer program which is used, the default setting for the Y axis rotation and the motion command for the cam 26Y is no movement and the cam 26Y remains out of contact with the baseball B at all times until a specific command for Y axis rotation is introduced into the system by the operator.

Below are examples of the degrees of rotation for several examples of pitches by each of the cam surfaces 26X and 26Y:

| PITCH | 26A ROTATION | 26B ROTATION |
|---|---|---|
| 4 seam fast ball | none | none |
| cut fast ball | 90 degrees | none |
| curve ball | none | none |
| slider | none | none |
| sinker | 90 degrees | none |
| changeup | none | none |

BASEBALL LIFTING, ORIENTATION AND INSERTION

When a baseball B is in Position 3 as shown in FIG. 9, the ball orienter 27 of FIGS. 6 and 14–16 is pivoted downward by drive motor 28 and belt 29 to the standard pick up position directly over the ball lifter 56 with its jaws 27G held open by solenoid 27SO of FIG. 15. Next, the ball lifter 56 of FIGS. 5 and 17A raises the baseball B out of the carousel 25 ring shaped carrier 54 to a standard position with its seams properly oriented in both the X and Y axes. The jaws 27G of the ball orienter 27 are closed about the baseball B by deenergization of solenoid 27SO and its spring 27SP. Next, the baseball orienter is rotated about the axis of shaft S by means of its motor 27M and belt 27B to the commanded spin axis orientation for the particular pitch under way. Typically the rotation of the ball orienter 27 will range from 90 degrees clockwise as viewed by the batter for a right-hand fast ball and 270 degrees for a left-hand fast ball as the extremes. These angles are illustrated in FIG. 43.

Baseball B is then directly before the entrance between the two wheels 20 and 21. Next the baseball inserter 30 which comprises a linear actuator when 30A with its rod 30B and an inserter head 30C is energized. The linear actuator 30A is driven electrically to advance the inserter head 30C of FIGS. 38–40 and its pair of spring loaded jaws 30D to grasp the baseball B in the exact seam orientation as determined by the ball seam rotators 26A and B. The baseball B is advanced until the pneumatically pressurized wheels grasp the ball simultaneously and launch it toward the plate 13 and batter at the correct spin axis, with the correct wheel speeds and speed differentials for the pitch commanded.

Any differential in the speed of the wheels 20 and 21, as well as the spin axis and seam orientation, will determine the baseball B trajectory to the plate.

EXTERNAL CONTROL AND INDICATORS

Figure 20A:
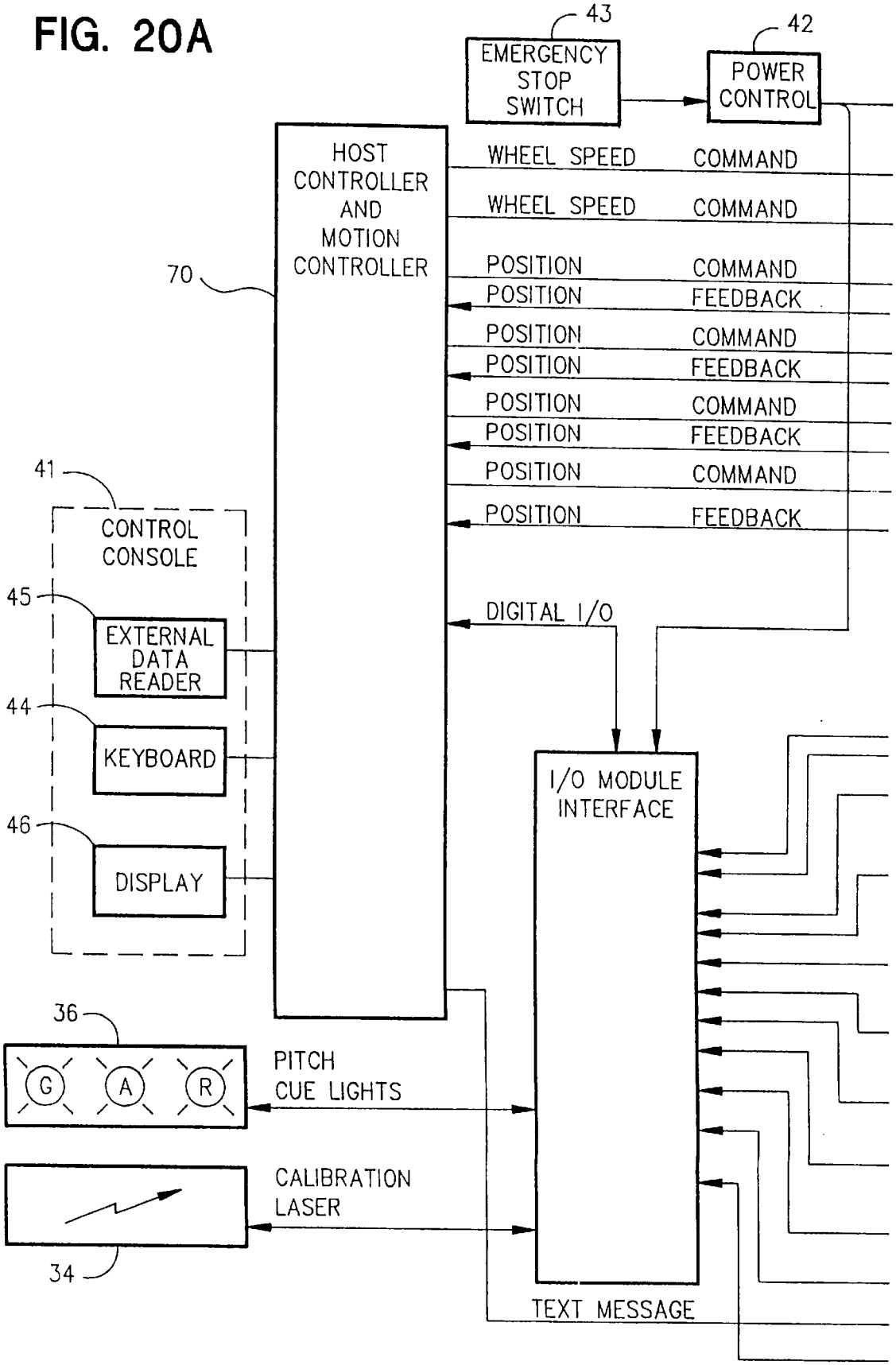
FIGS. 20 is a block diagram of the electronic circuitry of the pitching machine of FIG. 1.
Figure 20B:
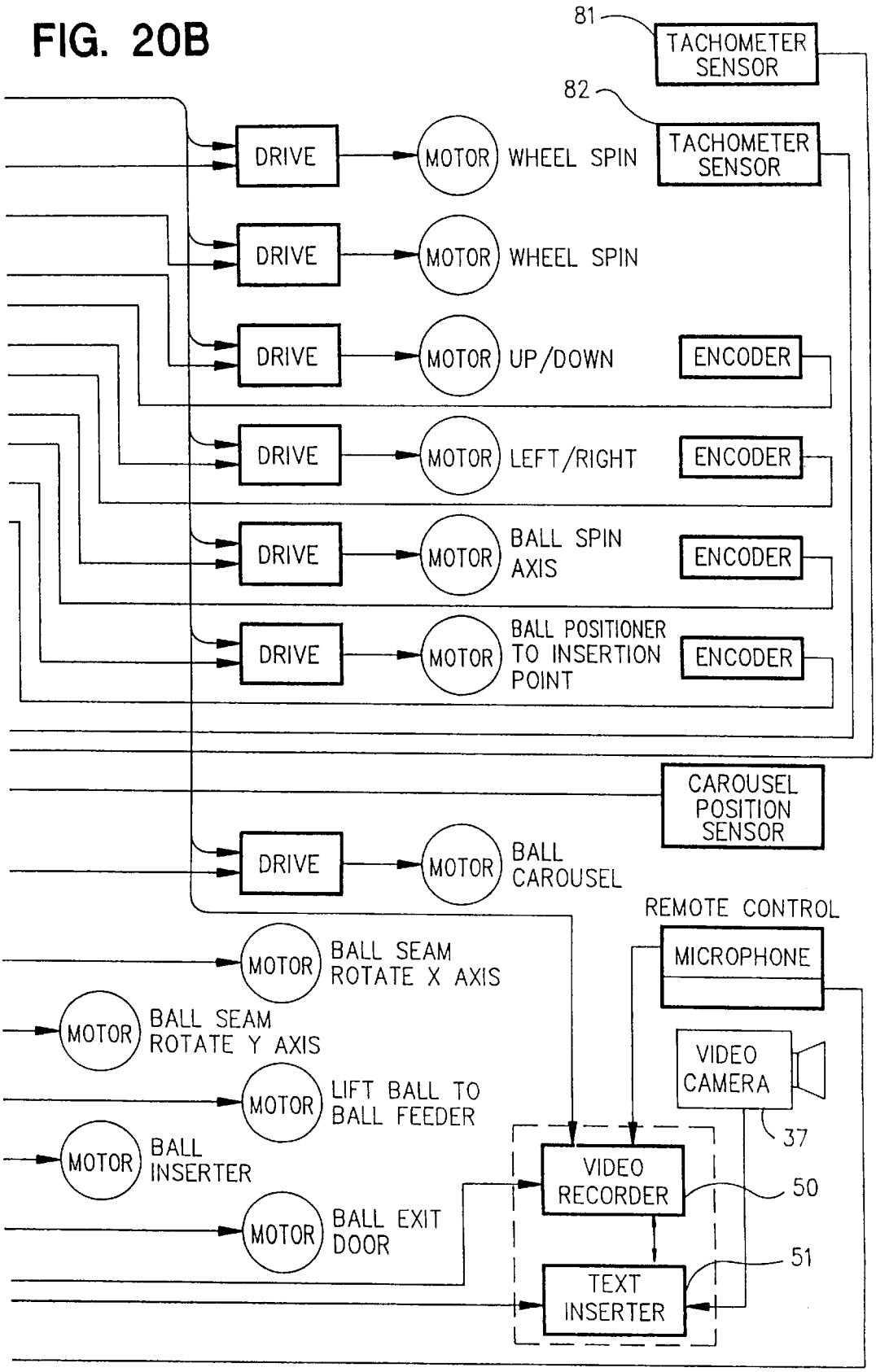

Employing this invention, the operator, in the primary mode of operation, stands behind the pitching machine 10 at the control console 41 and uses has keyboard 44 for inputting data or pitch commands as well as a data reader 45 for inputting accumulated data either about the batter or a pitcher or a lesson plan. He follows the displays appearing in sequence on the monitor screen 46. Examples of the screen displays are shown on FIGS. 45–50. The control circuitry for the pitching machine 10 is illustrated in FIG. 20.

The basic data handling and control of this invention is accomplished employing digital computer such as an ALR 386, IBM PC compatible computer 80 with at least 2 megabytes of RAM. Other computers, of course, may be used.

A status light assembly 36 is visible in FIG. 2 with three colored lamps red, amber and green which indicate to the batter the time to expect a pitch. The three lamps are visible to the left of the baseball delivery opening 40 which convey the following status information:

| | |
|---|---|
| ANY LAMP ILLUMINATED | MACHINE OPERATING (comparable line sequences) |
| GREEN LAMP ILLUMINATED | PITCHER AND CATCHER SELECTING PITCH<br>MACHINE BEGINNING PITCH DELIVERY CYCLE |
| AMBER LAMP ILLUMINATED | PITCHER IN WINDUP<br>BASEBALL WILL BE PITCHED WITHIN APPROXIMATELY 2 SECONDS |
| RED LAMP ILLUMINATED | PITCH DELIVERY AT PITCHERS RELEASE POINT |

These lamps give the batter a clear indication of the pitching machine condition and illumination of the amber lamp gives him warning that a pitch will be launched in approximately 2 seconds. This is comparable to the completion of the windup and actual delivery by a live pitcher.

The laser 34 is not illuminated at any time during play and the plate target 13A of FIGS. 1 and 1A has been removed before actual practice. Location of the plate 13 for calibration of the system is accomplished when the laser beam from source 34 is visible on the target 13A at the bottom center.

Note in FIGS. 3 and 19 that the player observes the pitching machine and an arcuate opening 40 but he does not see the wheels and more important he is not aware of the axis rotation of the delivery system 24. Thus the batter does not have any visual clues as to the type pitch about to be delivered.

The delivery cycle, for example, one pitch every 10 seconds, is designed to be constant so that the batter does not have a clue of any pitch sequence by result of the variation in time to adjust for each different pitch. Likewise the motor systems are quiet so that he does not hear any audible adjustment going on to give him a clue that the next pitch will be different from the last one delivered. This means that a batter's performance using this machine should be even better when facing an actual pitcher because of the visual clues given by the pitcher in preparation and delivery of each pitch and are not available to him when facing this pitching machine. For example, the machine 10 looks the same and sounds the same for a CUT Fast ball as for a CHANGEUP pitch. The batter must evaluate the pitch in the fraction of a second of flight. He must train himself to detect the seam rotation pattern and its effect on the ball as it reaches the plate.

COMPUTER CONTROLLED OPERATION

The operation of the pitching machine 10 employing computer 70 of FIGS. 5 and 20 is carried out by the software stored in the memory of the computer 80 and represented by the flow diagram of FIGS. 22 through 26 to which reference is now made.

Figure 21:
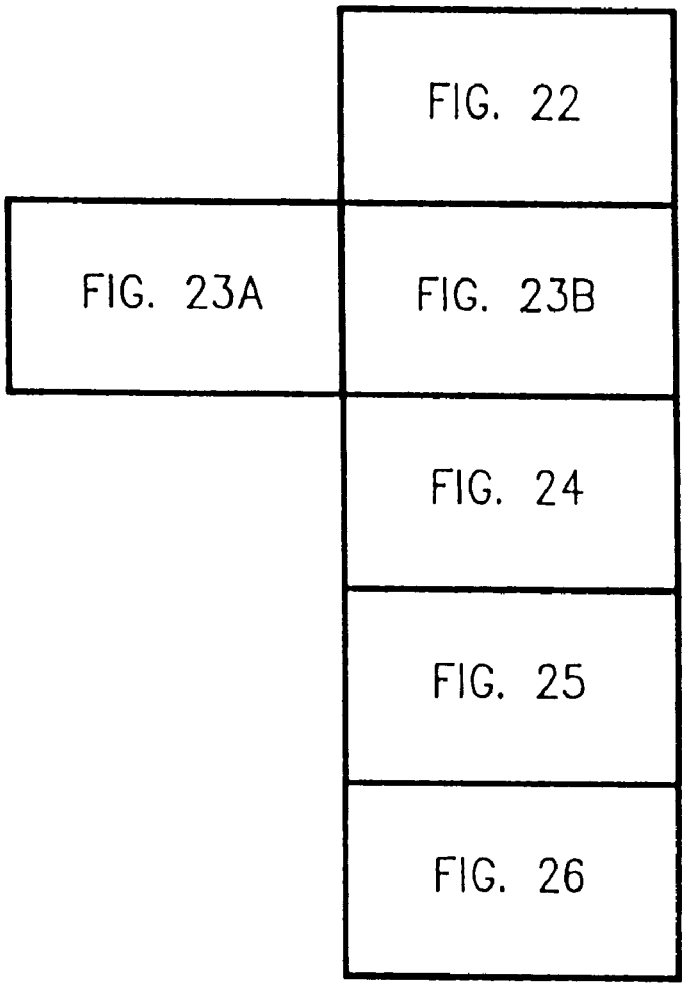
FIG. 21 is layout diagram for the flow diagram of FIGS. 22–26.

The start of operation of the pitching machine 10 is initiated by operating the ON switch to START the system. The machine conducts automatically initial diagnostics in a customary manner for computer systems including locating the travel limits of the spin, azimuth and vertical axis and home position of the ball feed. The calibration and alignment operation with the plate target 13A occurs in which the operator manually operates the keyboard controls using the arrow keys to adjust the X and Y axes of the delivery assembly 24 with the laser 34 illuminated and the target 13A temporarily located on the plate 13. The reflective surface 13A on the plate 13 will reflect the laser beam so that it is observable by the operator when the machine is properly centered and aligned with the plate 13. When the operator provides the YES answer to the alignment query of FIG. 21, the computer 70 begins and completes the calibration step for the alignment position and the main menu of FIG. 45 appears on the monitor screen 46.

Figure 22:
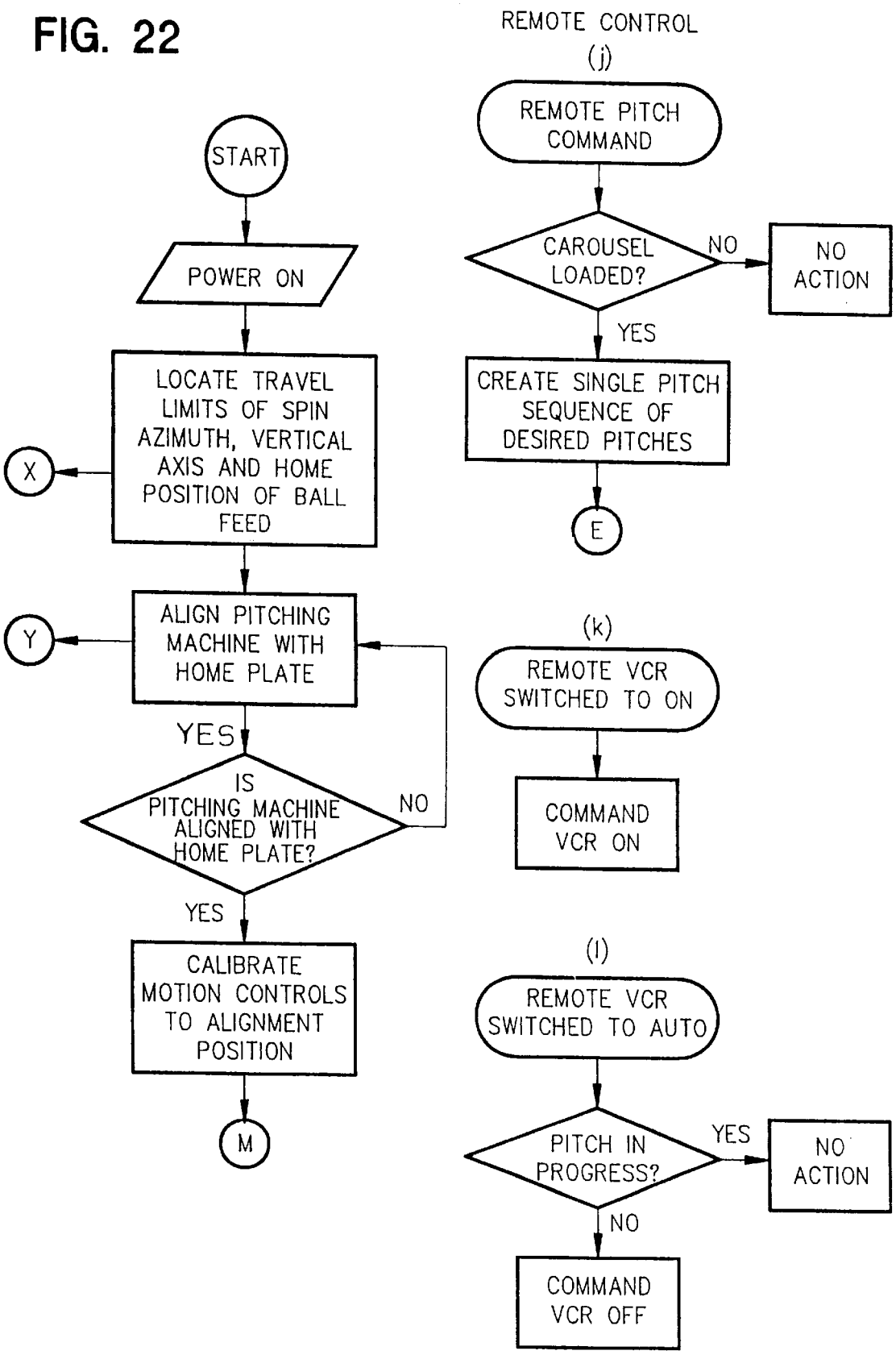
FIGS. 22 through 26 make up a flow diagram for the electronic controls for the pitching machine of FIG. 1.
Figure 23A:
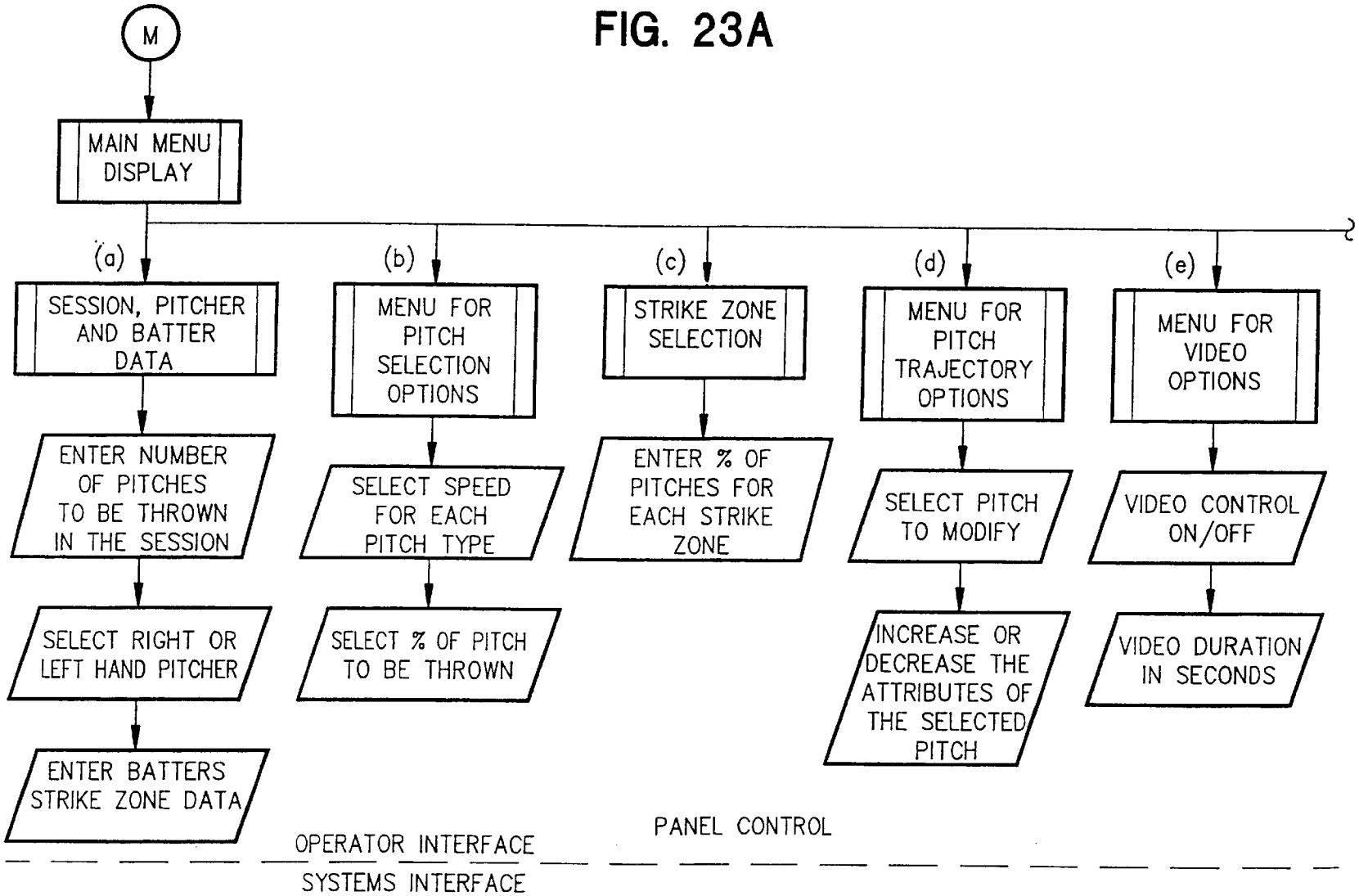
Figure 23B:
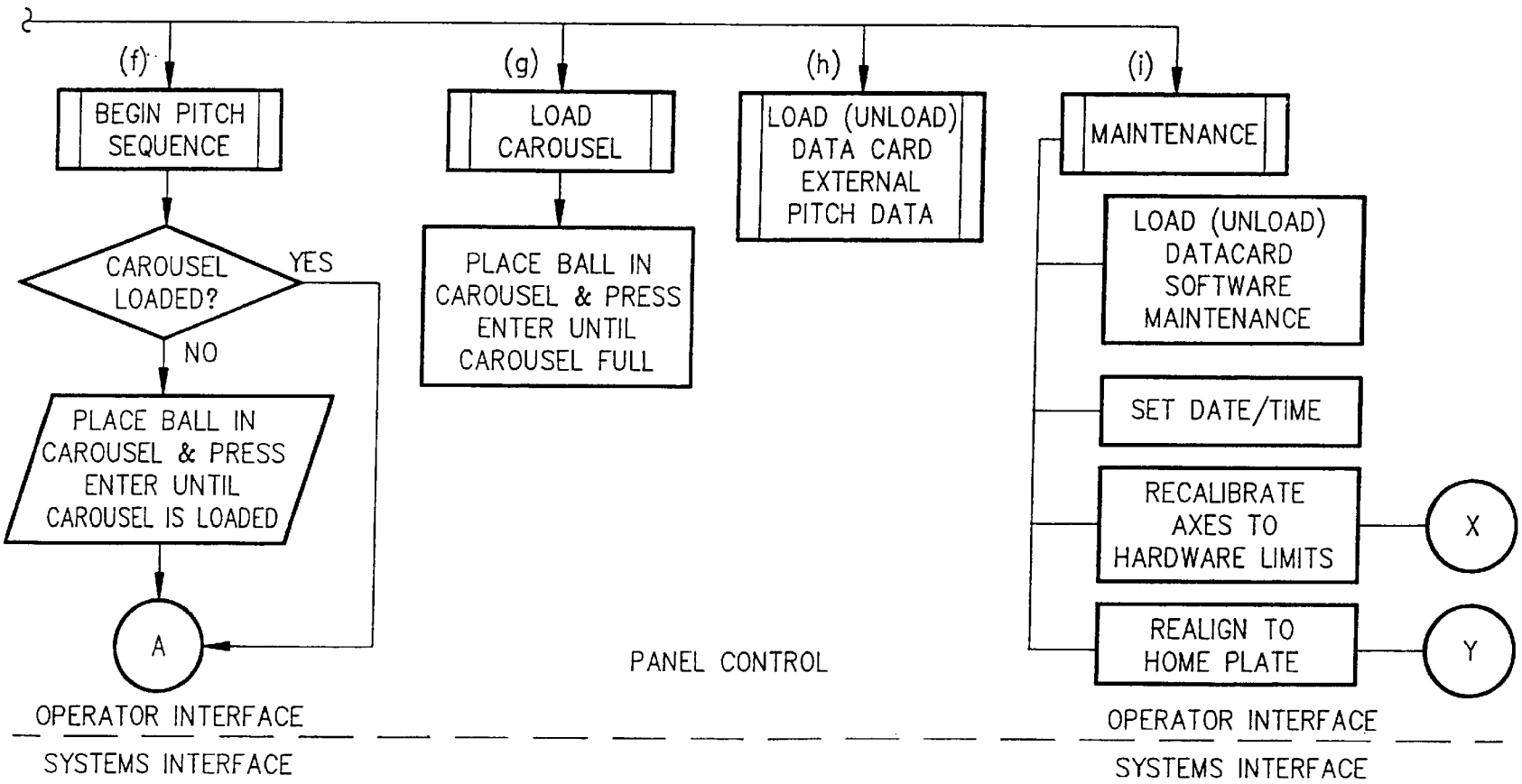
Figure 24:
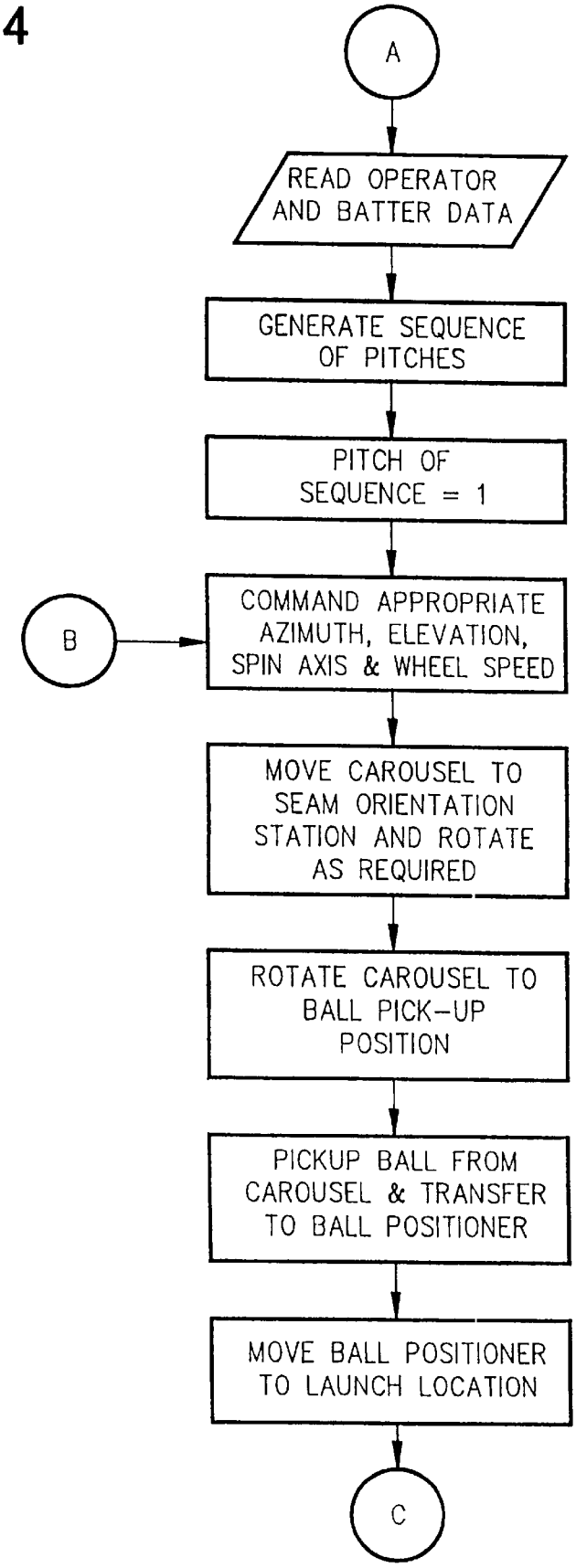
Figure 25:
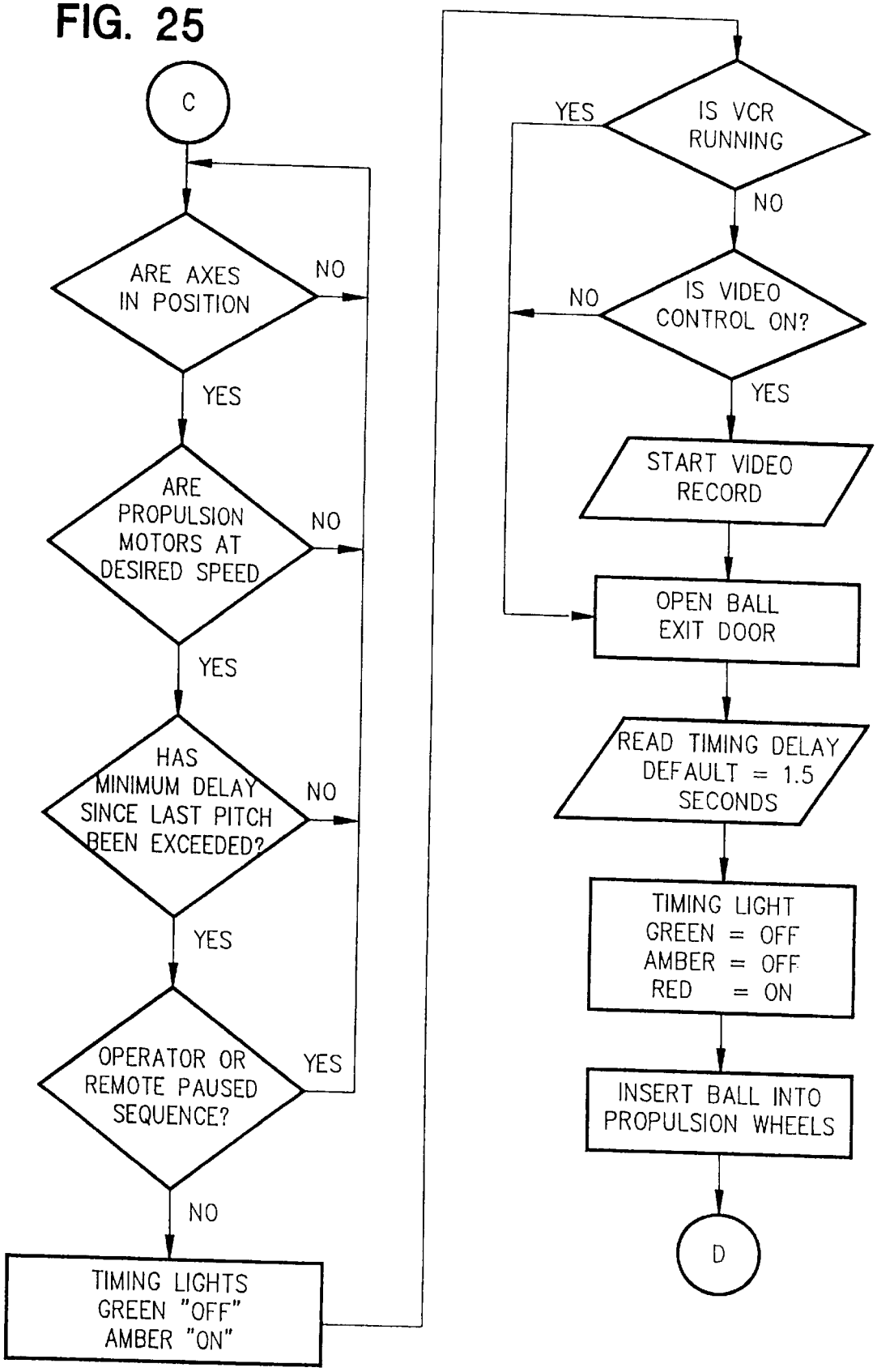
Figure 26:
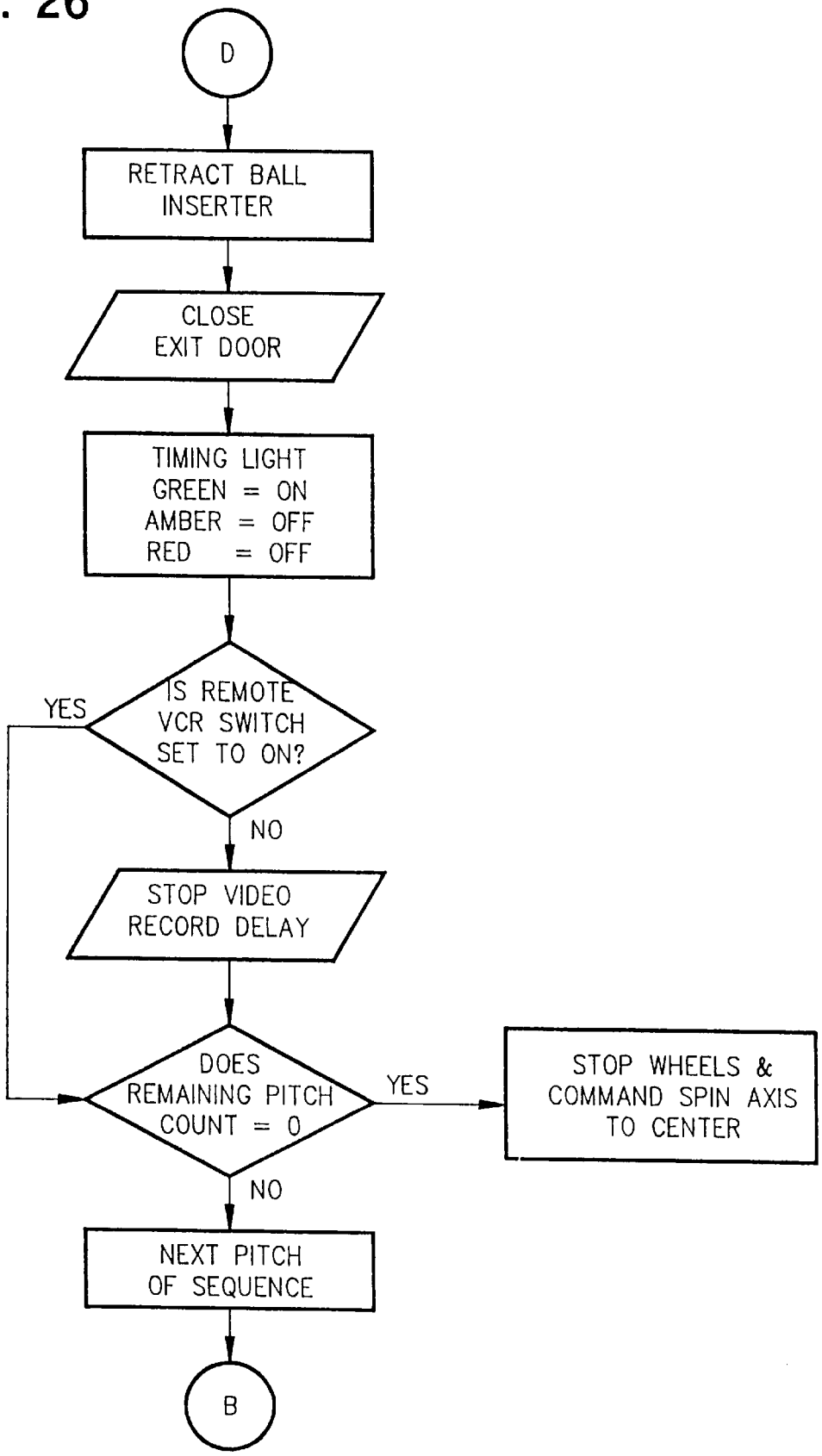
Figure 29:
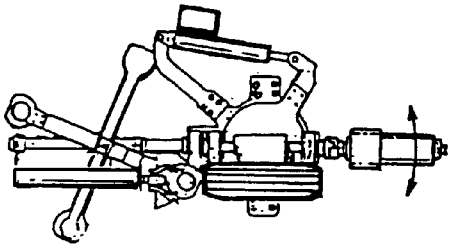
FIGS. 27, 28 and 29 constitute a series of top plan view of the ball feed and launch mechanisms of this invention with the ball transporting carousel in various locations.
Figure 29A:
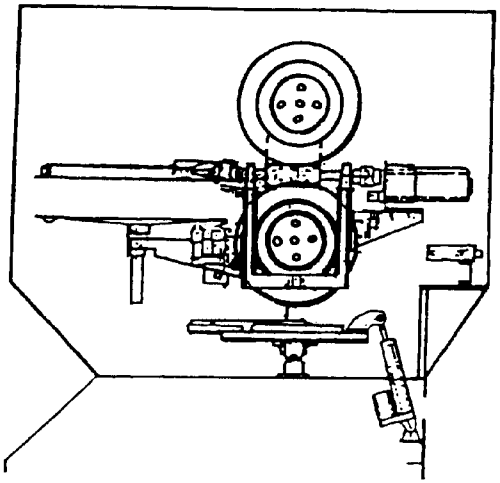
FIGS. 27A, 28A and 29A are side elevational views of the mechanisms corresponding the FIGS. 27–29.
Figure 28:
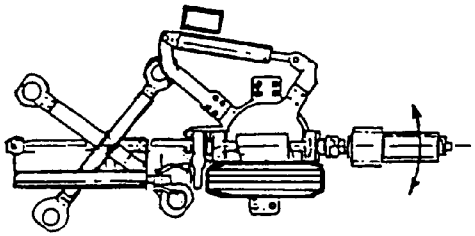
Figure 28A:
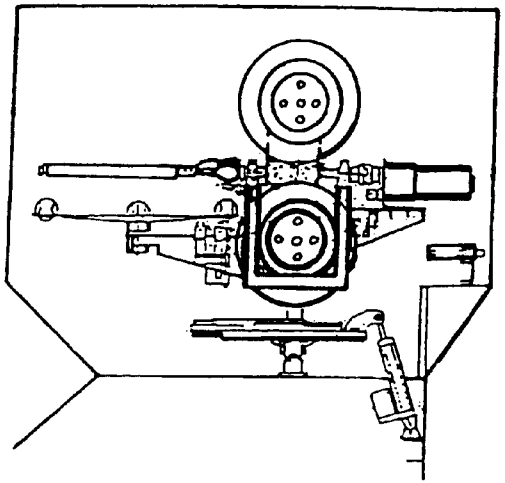
Figure 27:
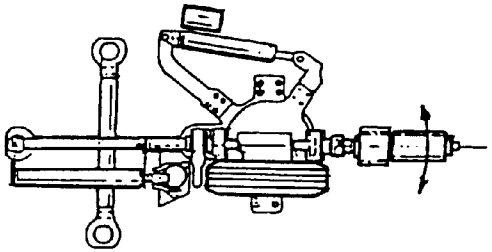
Figure 27A:
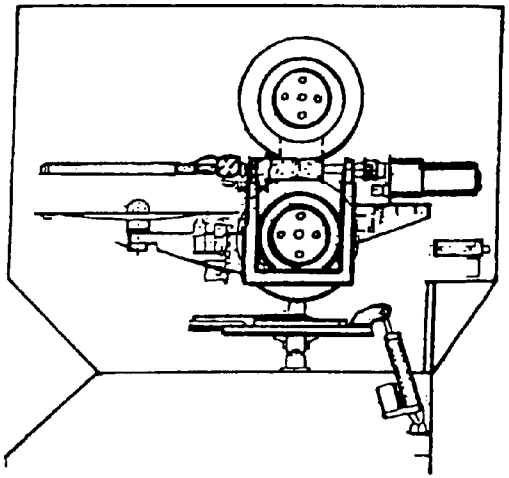

The screen 46 now provides selections (a) through (i) for the operator to which he will respond in any sequence but most logically from left to right in FIG. 22 and 23. Additional options (j), (k) and (l) are available at the REMOTE control of FIG. 56. At the left hand of the flow chart sequence for screen (a), the number of pitches in the series is entered on the keyboard, left or right handed pitcher is entered, batter's strike zone is entered, namely the distance from the ground to his knees and to underarm, as illustrated on FIG. 1A. Next, at screen (b), the pitch selections are made, namely speed, and percentage of each pitch type designated.

The operator then, at screen (c), selects the percentage of pitches to be thrown in each of the four zones 1–4 as seen in FIG. 1A. Typically pitches are not thrown into the upper third of the actual strike zone as defined in the Major League Rule Book.

As the operator elects the pitch speed for each type of pitch from the range provided with one mile per hour variables using the + and − keys of the keyboard. Typical examples of the range for each pitch type is shown below:

| PITCH TYPE | MINIMUM | MAXIMUM |
|---|---|---|
| Fast ball | 70 | 90 |
| CURVE | 70 | 78 |
| SLIDER | 70 | 86 |
| SINKER | 70 | 86 |
| CUT Fast ball | 70 | 86 |
| CHANGEUP | 60 | 75 |

As the next and final pitch configuration step, the operator at screen (d) indicates whether any trajectory options are desired. After selecting the pitch modification menu, the operator next selects the trajectory modification options and enters the options by the plus + and minus − keys of the keyboard.

The operator has the option at screen (e) of FIG. 23 of video taping the pitch series by powering up the video camera 37 with a cassette in place in the video recorder 50 and selecting a duration for each pitch cycle to be recorded. This eliminates any dead time or coach instruction time, if needed. Of course, the video may record the entire time that the batter is at the plate by selecting the maximum duration. If the operator intends to use the REMOTE control for the session, the selection of remote controls (k) and (l) will be used after leaving the control panel.

The operator next selects the LOAD CAROUSEL screen (g) and fills the carousel 25.

If the operator is using a data card with the data for the particular batter, he selects screen (h), inserts the batter's data card into slot 45 of the panel 41. The data card is read and any selection on the data card will be substituted for options of screens (a), (b), (c) and (d).

When the operator is satisfied with all MAIN MENU choices, he selects BEGIN PITCH SEQUENCE from the MAIN MENU, after which the sequence proceeds to the operational sequence. After the operator has placed the first baseball in the carrier of the carousel 25 nearest to the window 52 in the standard input orientation as shown in FIG. 32 and responds to the screen query with an ENTER that a baseball on the carousel 25. With that affirmative input, the computer 70 reads the stored operator and batter data and next generates the weighted random number for the pitch type selected and the zone location for intended delivery.

The computer 70 now controls three different operations, all of which may occur simultaneously, namely:

(1) Moves carousel 25 incrementally to the next position and the operator loads the next baseball until the carousel 25 presents the first baseball to the first seam orientation position where the baseball B is rotated in accordance with the seam rotation control signal, if any, has been supplied to the first seam rotator 26A. If none, the cam 26X of FIGS. 41 and 42 remains in a downward or out of the way position and the baseball in the carrier 54 will pass the seam rotation set without rotation. The carousel 25 is next advanced to the next or final seam rotation position for second seam rotation in the Y axis and is advances to next to the ball liftup position.

(2) Meanwhile, the counterrotating wheel spin axis is adjusted to the angle commanded by the computer 70;

(3) The V and AZ axis actuators 32 and 60 of FIGS. 11 and 12, respectively, are operated.

The operator has available a MAINTENANCE option screen (i). If screen (i) is selected and the option to recalibrate axes limits or plate alignment is selected, the sequence returns to points X or Y of FIGS. 22.

When each of these options have selected or declined, the operator selects the screen (f) to BEGIN PITCH SEQUENCE systems interface operation. When the carousel 25 is filled and verified by a screen response of the operator at (f), the SYSTEM INTERFACE begins controlling the system. If the operator, batter or coach elects the use of the REMOTE control, control of each pitch is possible using the remote pitch control at (j) or remote video control at (k) or (l).

Operator and batter data is read, the pitch type and location is selected and the weighted random number for pitch location and type is generated in computer 70 as is indicated in FIG. 23, the pitch location selected as well as trajectory adjustments, are made. Next, the computer 70 also provides speed control signals to the motor control circuits for both the motors 22 and 23 and tachometer sensor 81 and 82 of FIG. 20 have fed back the actual wheel speeds to the computer 70 for speed correction. The motors 22 or 23 either speed up or slowdown to the commanded speeds. The carousel is commanded to the seam orientation X and Y positions and seam orientation is completed, as directed. Next, the carousel 25 is rotated to the ball pickup position, the ball is ready to be picked up and moved to the launch position.

When YES inputs have been received from the carousel position, spin axis angle, ball seam X axis and Y axis indicating correct settings, and no PAUSE has occurred, the delivery subsystem 24 is now ready to receive a baseball. Ball pickup from the carousel 25 is commanded of the ball lifter 56 and oriented by the ball positioner 27. With all YES inputs received and the wheel speed correct, the baseball is ready for insertion into the counterrotating wheels.

When the baseball is in position for insertion and launch, the amber timing light is energized, the video recorder 50 is turned on, if in use. Next, a preselected or default delay occurs during which the door 35 is opened, the RED light is illuminated and the ball inserter 30 actuated and the baseball B introduced between the wheels 20 and 21 and is pitched, as commanded.

If the video system is operating in the AUTO mode, the camera 37 and the video recorder 50 are stopped after the pre-set record period (e.g. 2 seconds). The door 35 is closed and one number is deducted from the pitch series count. The sequence continues until a count of zero is reached.

During any pitch sequence, after a count is deducted, the green light is illuminated, the next random number pitch is selected and the next pitch routine begins. At the completion of the pitch sequence, the machine is commanded to the STOP position and the main menu appears again on the monitor 46.

MANUAL BALL INSERTER

After extensive testing of this pitching machine it became clear that improved performance can be achieved in other pitching machines which are hopper or tube fed. The ball injection head 30C of this invention served to accurately place the baseball between the wheels 20 and 21 with the seams in a precise position and produces designated pitches one after another. Therefore following the guidelines of seam orientation illustrated in FIGS. 32–36 and using a manually advanced ball inserter similar to the inserter 30 of FIGS. 38–40, the operation of any counterrotating wheel pitching machine may be improved. Such a manual baseball inserter is shown in FIGS. 51–54.

Figure 39:
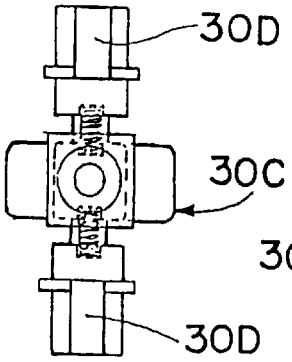
Figure 40:
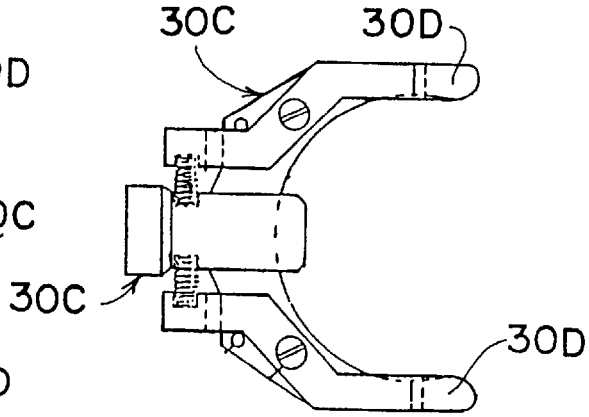

Referring now to FIGS. 51 and 52, a counterrotating wheel pair 20 and 21 mounted on arm A and driven by motors 22 and 23, are shown. Behind the direction of flight of a launched baseball as indicated by the arrow is a baseball B held by a manual inserter 100 supported on guide 101 and operated by handle 102. The guide 100 is mounted to move with the arm A. Each baseball B is inserted manually in ball insertion head 30C of FIGS. 38–40 or the head 103 of FIGS. 53 and 54. In either case, the baseball B is held at opposite sides by a pair of jaw members (30D or 104 and 105) with the baseball shown in dash lines in FIG. 53 resting against a stop 30C or 106. The ball gripper may be mechanically spring loaded as illustrated in FIGS. 39 and 40 above, however, we have found that a flexible plastic ball insertion head 103 of FIGS. 53 and 54 of approximately ½ inch thick acetal resin known by the trademark "Delrin" of the du Pont Company of Wilmington, Del. serves well as a resilient yet secure baseball holder. The ball insertion head is secured to the ball inserter shaft 101 by threaded extension of the shaft 100 and locknut N.

The ball insertion head 30C or 103 may be used on rod 101 without the guide 101 and handled as totally a manual ball inserter. The operator will then insure that the correct seam orientation is present and that he inserts the baseball at the correct spin axis.

REMOTE CONTROL FEATURE

In order to obtain the maximum advantage of this invention, it is recommended that the batter and his coach work together with the coach observing and instructing as the batter goes through a pitch sequence. Teaching is enhanced when the coach can remain in control of the pitching session and can interrupt and modify it at any time for further instruction. The coaches oral instructions, if recorded on the video tape, can further document the training session. Then the batter can later observe his own performance on a video screen while again hearing his coaches instructions.

These advantages can be accomplished employing the added features found in FIGS. 55 and 56 awhile referring to the flow diagram of FIGS. 22–26. In FIG. 55, the pitching machine 10 is shown in the screening system 14 with its normal control panel 41 and video recorder 50 in their normal places at the rear side of the pitching machine 10. A cable C is connected to the control panel 45 providing certain duplicate and certain controls to the pitching machine 10. The cable C terminates at a remote control RC which is located outside of the screening system 14 and accessible to the batting coach. The cable C may be permanently installed between the pitching machine 10 and the remote control RC but sufficient freedom should be given to the batting coach to allow him to stand wherever he desires while instructing the batter and controlling the pitching machine 10.

The remote control RC includes at least three controls for the pitching machine baseball launching subassembly and one for the video recorder. They include START/CONTINUE control switch 90 used to command the instant of launch of the next pitch. This control will start a pitch sequence which has been programmed into the host computer controller 80. A PAUSE control switch 91 will interrupt any pitch sequence until the START/CONTINUE control switch 90 is operated. These two controls allows the batting coach to interrupt the machine controlled pitching sequence and to allow him as much time as he desires to instruct the batter. A STOP control switch 92 allows the coach to terminate the session at any time.

The remote control RC also includes a microphone M with a two-position VCR control switch 93 with one position to START recording of video and audio and the second position AUTO to maintain the video recorder under the control of the control panel 41. In either case the recording of the batter and the pitch sequence is accomplished by the video camera 37 on a video tape contained in the video recorder 50. When the remote control RC is operative and the switch 93 is in the ON position, the conversations of the batting coach and responses by the batter are picked up by the microphone M and recorded on the audio track of the video tape of recorder 50, as well.

Optionally, the coach may want to vary the training sequence which he has previously entered into the batting machine control panel 41. Inasmuch as the baseball seam rotation occurs at the end of the baseball transport cycle as is illustrated in FIGS. 4, 8 and 9, it is possible to vary the next pitch. In such case the individual pitch control switches FS, CB, SL, CF, or CH on the remote control may be operated to provide a fast ball, curve ball, slider, sinker, cut fast ball or a changeup, respectively, on the next pitch. The coach or the batter may select the actual zone for the next pitch by operating any one of the zone selection switches Z1 through Z4 on the remote control RC. The switches on the remote control RC are connected to the control console 41 and act as key operations on the keyboard 44.

The foregoing description represents the best mode known to the inventors of carrying out this invention but must be recognized as merely representative of this invention and not as limiting. It is well recognized that one might produce a system which may appear different but does not depart from the spirit and substance of this invention. Therefore, this invention is defined by the following claims including the added protection afforded by the Doctrine of Equivalents.

We claim:

1. In a baseball pitching machine including counterrotating wheels for pitching a seamed baseball with a particular seam orientation to be pitched from between the wheels and including motor means for driving the counterrotating wheels and yoke means for mounting the counterrotating wheels with an opening area therebetween for receiving a baseball to be pitched;

a baseball inserter comprising a ball gripper having a pair of jaws for grasping a baseball;

said jaws being resilient for holding a baseball;

a shaft for supporting said baseball gripper for reciprocal movement from an outward position for loading a baseball in said jaws and an inward position for allowing the counterrotating wheels of the pitching machine to engage the baseball;

means mounting said shaft for reciprocal movement toward and away from said counterrotating wheels with said pair of jaws being in non-interfering relationship with said counterrotating wheels; and said resilient jaws allowing release of a baseball held within said jaws upon engagement of the baseball with the counterrotating wheels while maintaining the particular seam orientation of the baseball.

2. A baseball inserter in accordance with claim 1 including means mounting said baseball inserter on said yoke whereby any change in orientation of said yoke and said counterrotating wheels is reflected in the orientation of said baseball inserted.

3. A baseball inserter in accordance with claim 1 wherein said ball gripper includes stop means between said jaws for limiting the extent of insertion of a baseball within said ball gripper.

4. A baseball inserter in accordance with claim 1 wherein said baseball gripper is an integral resilient member.

5. A baseball inserter in accordance with claim 1 wherein said laws are pivotally spring loaded with respect to said ball gripper.

6. A baseball inserter in accordance with claim 3 wherein said stop means is rigidly positioned relative to said shaft.

7. A baseball inserter comprising:

a baseball gripper having a pair of jaws for grasping a seamed surface baseball;

said jaws resiliently holding a baseball;

a shaft for supporting said baseball gripper for reciprocal movement from one position for loading a baseball in said jaws and a second position for insertion in a baseball pitching machine to engage the baseball;

said pair of jaws gripping a baseball on opposite sides thereof for non-interfering relationship with a baseball pitching machine; and said resilient jaws allowing release of a baseball held within said jaws upon engagement of the baseball with the baseball pitching machine while maintaining the seam orientation of the baseball as inserted into said jaws.

8. A baseball inserter in accordance with claim 7 wherein said jaws are formed integrally as a part of said baseball gripper; and said baseball gripper including stop means for limiting the insertion of a baseball into said baseball gripper.

9. A baseball inserter in accordance with claim 7 wherein said baseball gripper includes a head member secured to said shaft wherein said jaws are pivotally secured to said head member;

means biasing said jaws in a baseball holding direction; and said head member including stop means for limiting the insertion of a baseball in said jaws.

10. A baseball inserter in accordance with claim 7 for use with baseball pitching apparatus for seamed surface baseballs wherein said jaws include outer and inner surfaces; and said inner surfaces being concave and dimensioned to conform to a substantial length of the surface of a baseball to grip its surface and maintain its seam orientation while the baseball is being inserted into a baseball pitching apparatus.

11. A baseball inserter in accordance with claim 7 for use with baseball pitching apparatus for seamed surface baseballs wherein said stop means includes an inner surface; and said inner surface being configured to engage the surface of a baseball to aid in the gripping a baseball and maintaining a selected seam orientation of the baseball in cooperation with said jaws while the baseball is being inserted into a baseball pitching apparatus.

* * * * *